US007672785B2

(12) United States Patent
Newman

(10) Patent No.: US 7,672,785 B2
(45) Date of Patent: Mar. 2, 2010

(54) METHOD AND SYSTEM FOR EVALUATING AND DISPLAYING DEPTH DATA

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 236 days.

(21) Appl. No.: 11/691,031

(22) Filed: Mar. 26, 2007

(65) Prior Publication Data

US 2008/0035335 A1 Feb. 14, 2008

Related U.S. Application Data

(60) Provisional application No. 60/786,273, filed on Mar. 27, 2006.

(51) Int. Cl.
*G06F 19/00* (2006.01)

(52) U.S. Cl. ..... 702/9; 235/449

(58) Field of Classification Search ..... 702/82–185, 702/187–188, 6, 9; 235/375
See application file for complete search history.

(56) References Cited

U.S. PATENT DOCUMENTS

| | | | | |
|---|---|---|---|---|
| 4,393,485 A | | 7/1983 | Redden | |
| 4,545,017 A | | 10/1985 | Richardson | |
| 4,660,419 A | | 4/1987 | Derkacs et al. | 73/622 |
| 4,700,142 A | | 10/1987 | Kuckes | |
| 4,779,201 A | | 10/1988 | Iisuka et al. | 702/10 |
| 4,851,773 A | * | 7/1989 | Rothstein | 324/220 |
| 5,043,663 A | | 8/1991 | Lam | 324/242 |
| 5,051,962 A | | 9/1991 | Eaton | |
| 5,193,628 A | | 3/1993 | Hill et al. | 175/45 |
| 5,218,301 A | | 6/1993 | Kuckes | |
| 5,237,539 A | | 8/1993 | Selman | |
| 5,278,549 A | | 1/1994 | Crawford | |
| 5,491,668 A | | 2/1996 | Priest | 367/35 |

(Continued)

FOREIGN PATENT DOCUMENTS

WO WO 2004/074808 A2 9/2004

OTHER PUBLICATIONS

PCT/US07/64948 International Search Report and the Written Opinion of the International Searching Authority, or the Declaration—Date of mailing Dec. 17, 2007.

(Continued)

*Primary Examiner*—Edward Raymond
(74) *Attorney, Agent, or Firm*—King & Spalding LLP

(57) ABSTRACT

A method and apparatus for displaying depth of positional data with tubing analysis data obtained by instruments analyzing tubing sections being withdrawn from a well includes an apparatus for communicably linking an encoder or other positional or depth sensors to the tubing analysis data processor. In addition, sensors capable of detected collars holding pieces of tubing section together can transmit signals to the analysis data processor that a collar has been detected and insert collar location information into the analysis data. Furthermore, information based on the length of the individual pieces of tubing or the data from the encoder or other positional sensor can be analyzed or associated with the analysis data and displayed with the analysis data by overlaying a depth component on a display of the analysis data.

35 Claims, 14 Drawing Sheets

U.S. PATENT DOCUMENTS

| | | | | |
|---|---|---|---|---|
| 5,548,900 | A | 8/1996 | Hunt-Grubbe | 33/302 |
| 5,626,192 | A | 5/1997 | Connell et al. | 166/255.1 |
| 5,678,643 | A | 10/1997 | Robbins et al. | 175/45 |
| 5,947,213 | A | 9/1999 | Angle et al. | 175/24 |
| 6,021,093 | A | 2/2000 | Birchak | |
| 6,079,490 | A | 6/2000 | Newman | 166/77.51 |
| 6,209,639 | B1 | 4/2001 | Newman | |
| 6,285,955 | B1 | 9/2001 | Goldwasser | 702/6 |
| 6,316,937 | B1 | 11/2001 | Edens | 324/220 |
| 6,347,292 | B1 | 2/2002 | Denny et al. | 702/188 |
| 6,359,434 | B1 | 3/2002 | Winslow et al. | 324/220 |
| 6,377,189 | B1 | 4/2002 | Newman | 340/854.6 |
| 6,411,084 | B1 | 6/2002 | Yoo | 324/221 |
| 6,571,634 | B1 | 6/2003 | Bazarov et al. | 73/623 |
| 6,728,638 | B2 | 4/2004 | Newman | 702/5 |
| 6,760,665 | B1 | 7/2004 | Francis | 702/6 |
| 6,896,056 | B2 | 5/2005 | Mendez et al. | 166/254.2 |
| 7,006,920 | B2 | 2/2006 | Newman | |
| 2004/0226712 | A1 | 11/2004 | Hood et al. | 166/66 |
| 2005/0194182 | A1 | 9/2005 | Rodney et al. | 175/24 |
| 2005/0267686 | A1 | 12/2005 | Ward | 702/6 |
| 2006/0047430 | A1 | 3/2006 | Edwards | 702/6 |

OTHER PUBLICATIONS

PCT/US07/64964 International Search Report and Written Opinion of the International Searching Authority, or Declaration—Date of mailing Feb. 22, 2008.

PCT/US07/64894 International Search Report and Written Opinion of the International Searching Authority, or Declaration—Date of mailing Feb. 7, 2008.

PCT/US07/65032 International Search Report and Written Opinion of the International Searching Authority, or Declaration—Date of mailing Jul. 2, 2008.

PCT/US07/64846 International Search Report and Written Opinion of the International Searching Authority, or Declaration—Date of mailing Dec. 12, 2007.

* cited by examiner

920

922 924 926 928

| Sensor Data Point Counter (S) | Data Value | Position Counter (D) | Depth (in feet) |
|---|---|---|---|
| 1 | 0.1 | 1 | 2 |
| 2 | 0.2 | 2 | 7 |
| 3 | 0.13 | 3 | 15 |
| 4 | 0.15 | 4 | 19 |
| 5 | 0.2 | 5 | 25 |
| 6 | 4.8 | 6 | 30 |
| 7 | 0.2 | 7 | 33 |
| 8 | 0.15 | 8 | 36 |
| 9 | 0.3 | 9 | 39 |
| 10 | 0.4 | 10 | 42 |
| 11 | 0.2 | 11 | 45 |
| 12 | 0.3 | 12 | 48 |
| 13 | 0.1 | 13 | 51 |
| 14 | 0.15 | 14 | 54 |
| 15 | 0.25 | 15 | 57 |
| 16 | 4.3 | 16 | 60 |
| 17 | 0.2 | 17 | 66 |
| 18 | 0.4 | 18 | 74 |
| 19 | 0.25 | 19 | 80 |
| 20 | 0.15 | 20 | 83 |

Figure 9B

METHOD AND SYSTEM FOR EVALUATING AND DISPLAYING DEPTH DATA

This application claims benefit of U.S. Provisional Application Ser. No. 60/786,273, filed on Mar. 27, 2006.

FIELD OF THE INVENTION

The present invention relates to methods of analyzing oil field tubing as it is being inserted into or extracted from an oil well. More specifically, the invention relates to a method and apparatus for communicably relating positional and collar locating means to tubing analysis data and including depth or positional data with the analysis data.

BACKGROUND

After drilling a hole through a subsurface formation and determining that the formation can yield an economically sufficient amount of oil or gas, a crew completes the well. During drilling, completion, and production maintenance, personnel routinely insert and/or extract devices such as tubing, tubes, pipes, rods, hollow cylinders, casing, conduit, collars, and duct into the well. For example, a service crew may use a workover or service rig to extract a string of tubing and sucker rods from a well that has been producing petroleum. The crew may inspect the extracted tubing and evaluate whether one or more sections of that tubing should be replaced due physical wear, thinning of the tubing wall, chemical attack, pitting, or another defect. The crew typically replaces sections that exhibit an unacceptable level of wear and note other sections that are beginning to show wear and may need replacement at a subsequent service call.

As an alternative to manually inspecting tubing, the service crew may deploy an instrument to evaluate the tubing as the tubing is extracted from the well and/or inserted into the well. The instrument typically remains stationary at the wellhead, and the workover rig moves the tubing through the instrument's measurement zone. The instrument typically measures pitting and wall thickness and can identify cracks in the tubing wall. Radiation, field strength (electrical, electromagnetic, or magnetic), and/or pressure differential may interrogate the tubing to evaluate these wear parameters. The instrument typically samples a raw analog signal and outputs a sampled or digital version of that analog signal.

In other words, the instrument typically stimulates a section of the tubing using a field, radiation, or pressure and detects the tubing's interaction with or response to the stimulus. An element, such as a transducer, converts the response into an analog electrical signal. For example, the instrument may create a magnetic field into which the tubing is disposed, and the transducer may detect changes or perturbations in the field resulting from the presence of the tubing and any anomalies of that tubing.

While the instrument can provide important and detailed information about the damage or wear to the tubing, this data can be difficult to analyze for single sections of tubing and even more difficult for an entire stand of tubing withdrawn from a well. While the instrument typically outputs data at or near a constant rate, the speed at which the tubing is withdrawn from the well is variable. At least a portion of the variability in speed is necessitated by the fact that the tubing sections must be separated from one another. During separation, the workover rig comes to a complete stop and the tubing section is separated form a collar that holds two pieces of tubing together. Once the particular tubing section is separated and stored, the workover rig can continue withdrawing the next section of tubing from the well. Variability in speed can also be caused by the fact that there is no predetermined speed at which oilfield service operators are instructed to withdraw the tubing from the well. Furthermore, tight speed control and monitoring has not historically been seen as an important factor in tubing removal.

Because of the speed variations the data output by the instrument and displayed on a display panel is typically inconsistent. For example, if a long delay occurs in uncoupling one tubing section from another, the display of the data from the instrument could cover an area greater than the viewable area of the display screen. This may lead the operator to make evaluations of the tubing section based on partial data, because the operator may not be able to determine when the tubing section began and ended in the data displayed. On the other hand, if the operators are able to withdraw and separate the tubing quickly, the display could potentially display more than one tubing section. In this situation, the operator could make decisions for one tubing section based on data that was actually from a different section of tubing.

Furthermore, once all of the tubing has been removed from the well and the data is charted, the data may include information showing particular problems within the well. However, to date, the analysis data does not include the capability of displaying the data with a depth component so that the operators can determine exactly where in the well the problem is occurring and focus their repair analysis on that particular section.

To address these representative deficiencies in the art, what is needed is an improved capability for evaluating tubing analysis. For example, a need exists for communicably tying the information output from an encoder or other positional sensor on the workover rig with the computer processing the tubing analysis data. Furthermore, a need exists for apparatus and method for reliably detecting collars on the tubing sections and displaying the position of the collars in relation to the other tubing analysis data being processed. Another need exists for a method of providing positional or depth data with the tubing analysis data displayed for oilfield service operators to assist in detecting major problems or data anomalies from the well and tubing analysis. A capability addressing one or more of these needs would provide more accurate, precise, repeatable, efficient, or profitable tubing evaluations.

SUMMARY OF THE INVENTION

The present invention supports evaluating an item, such as a piece of tubing or a rod, in connection with placing the item into an oil well or removing the item from the oil well and displaying the data for analysis. Evaluating the item can comprise sensing, scanning, monitoring, inspecting, assessing, or detecting a parameter, characteristic, or property of the item.

In one aspect of the present invention, an instrument, scanner, or sensor can monitor tubing, tubes, pipes, rods, hollow cylinders, casing, conduit, collars, or duct near a wellhead of the oil well. The instrument can comprise a wall-thickness, rod-wear, collar locating, crack, imaging, or pitting sensor, for example. As a field service crew extracts tubing from the oil well or inserts the tubing into the well, the instrument can evaluate the tubing for defects, integrity, wear, fitness for continued service, or anomalous conditions. The instrument can provide tubing information in a digital format, for example as digital data, one or more numbers, samples, or snapshots. The instrument can also include sensors for detecting collars positioned between each tubing section. Upon sensing a collar, the information can be applied to the other data obtained by the instrument and displayed for analysis.

By displaying the location of the collars, an analyzer can accurately analyze each individual piece of tubing. By adding data to the display to designate the collars, the instrument can improve the reliability of analyzing the wear on the tubing.

In another exemplary embodiment, a section of tubing including a collar can be passed through the instrument to determine the output level of the instrument when it detects a collar. The tubing sections can then be removed from the well. As the tubing sections are being removed and data from the instrument is being displayed on a computer or screen, the computer can determine the location of the collars between each piece of tubing based on the initial levels seen from the instrument. Data relating to the length of each piece of tubing can be input into the computer and the computer can highlight areas determined to be collars on the display of the analysis data. Further, based on the length data received, the computer can display a positional or depth axis with the analysis data based on the previously determined collar locations.

In another exemplary embodiment, an encoder or other positional or depth sensor can be communicably linked with the computer processing the analysis data for the tubing from the instrument. As analysis data is being received from the instrument, the computer can also receive or obtain depth or positional data and associate that data with the particular analysis data points. The computer can then display the analysis data on a chart and overlay a depth axis onto the analysis data chart.

In another exemplary embodiment, the present invention provides a method for evaluating tubing data on an oil rig. The method includes the steps of moving a plurality of pipe segments into or out of a well and analyzing the pipe segments with a tubing scanner, wherein tubing scanner generating a first signal associated with the condition said pipe segments. The location of a plurality of collars connecting said pipe segments is determined, preferably with collar locating sensors, and the length of each pipe segment is determined. The relative position of each pipe segment is correlated to the first signal and the tubing scanner and pipe segment positional data is displayed. In one embodiment the tubing scanner includes a sensor selected from a wall-thickness sensor, a rod-wear sensor, a collar locating sensor, a crack sensor, an imaging sensor or a pitting sensor. In another embodiment, the length of the pipe segments are determined by correlating positional data from an encoder and the location of the collars. In one embodiment, the correlated data is transmitted to a remote location, in another embodiment, the tubing scanner data can be used to evaluate the pipe segments for defects, integrity, wear, anomalous conditions, or fitness for continued service.

The discussion of processing tubing data presented in this summary is for illustrative purposes only. Various aspects of the present invention may be more clearly understood and appreciated from a review of the following detailed description of the disclosed embodiments and by reference to the drawings and any claims that may follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by any accompanying claims.

BRIEF DESCRIPTION OF THE DRAWINGS

FIGS. 9, 9A, and 9B are exemplary charts and data tables displaying the steps for overlaying the associated depth data on the analysis data chart in accordance with one exemplary embodiment of the present invention;

Figure 1:
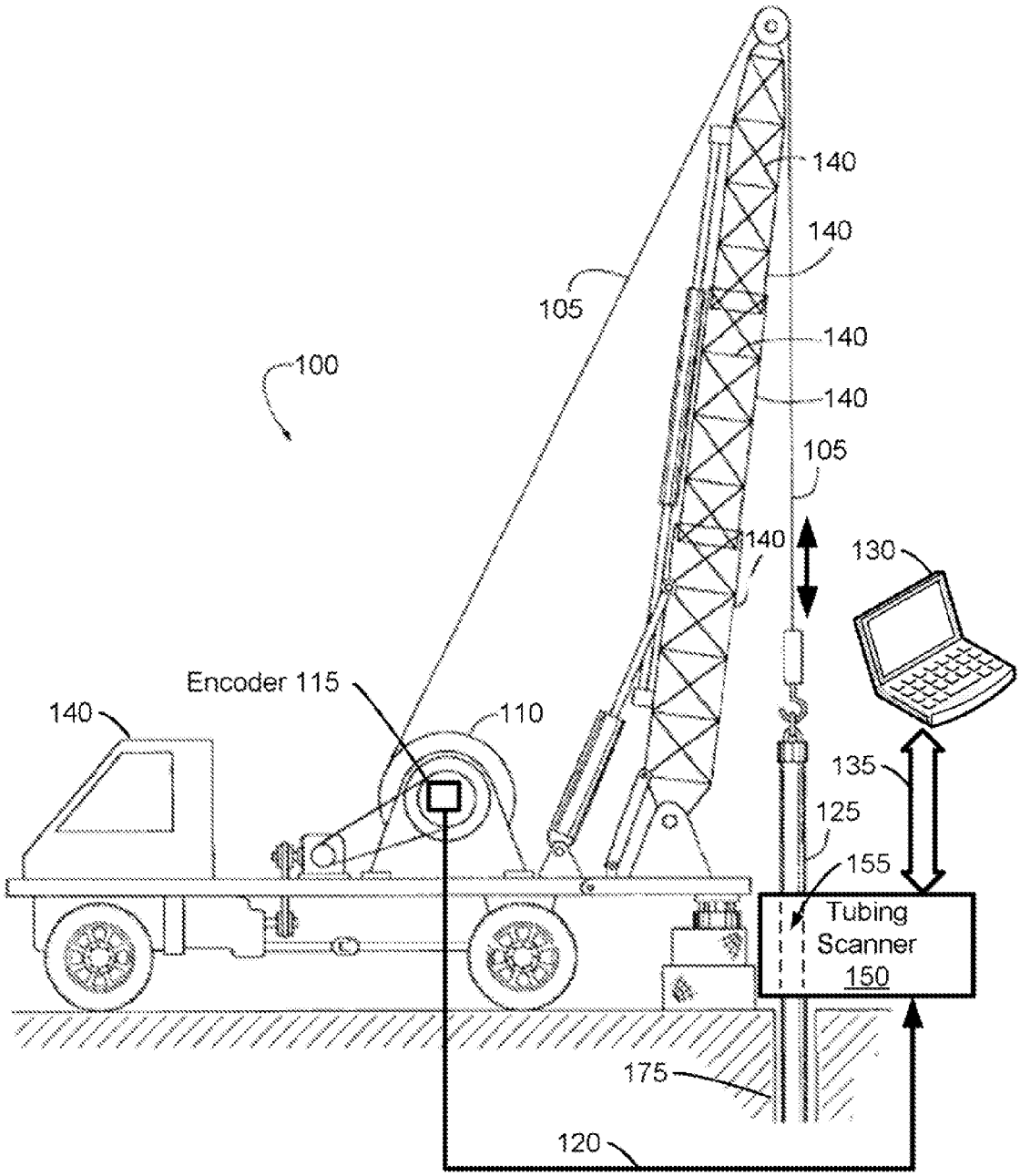
FIG. 1 is an illustration of an exemplary system for servicing an oil well that scans tubing as the tubing is extracted from or inserted into the well in accordance with an embodiment of the present invention.

Many aspects of the invention can be better understood with reference to the above drawings. The components in the drawings are not necessarily to scale. Instead, emphasis has been placed upon clearly illustrating the principles of the exemplary embodiments of the present invention. Moreover, in the drawings, reference numerals designate like or corresponding, but not necessarily identical, elements throughout the several views.

DETAILED DESCRIPTION OF EXEMPLARY EMBODIMENTS

The present invention supports methods for retrieving and displaying tubing analysis data with corresponding depth data associated with the tubing analysis data from tubing sections retrieved or inserted into an oil well to improve the ability of an oilfield service crew to determine problems with the well or tubing and determine if the data provided in the analysis scan does not make sense. Providing consistent reliable analysis data and displaying it in a consistent and easy to understand manner will help an oilfield service crew can make more efficient, accurate, and sound evaluations of the well and the tubing, collars and sucker rods used in the operation of the well.

Figure 2:
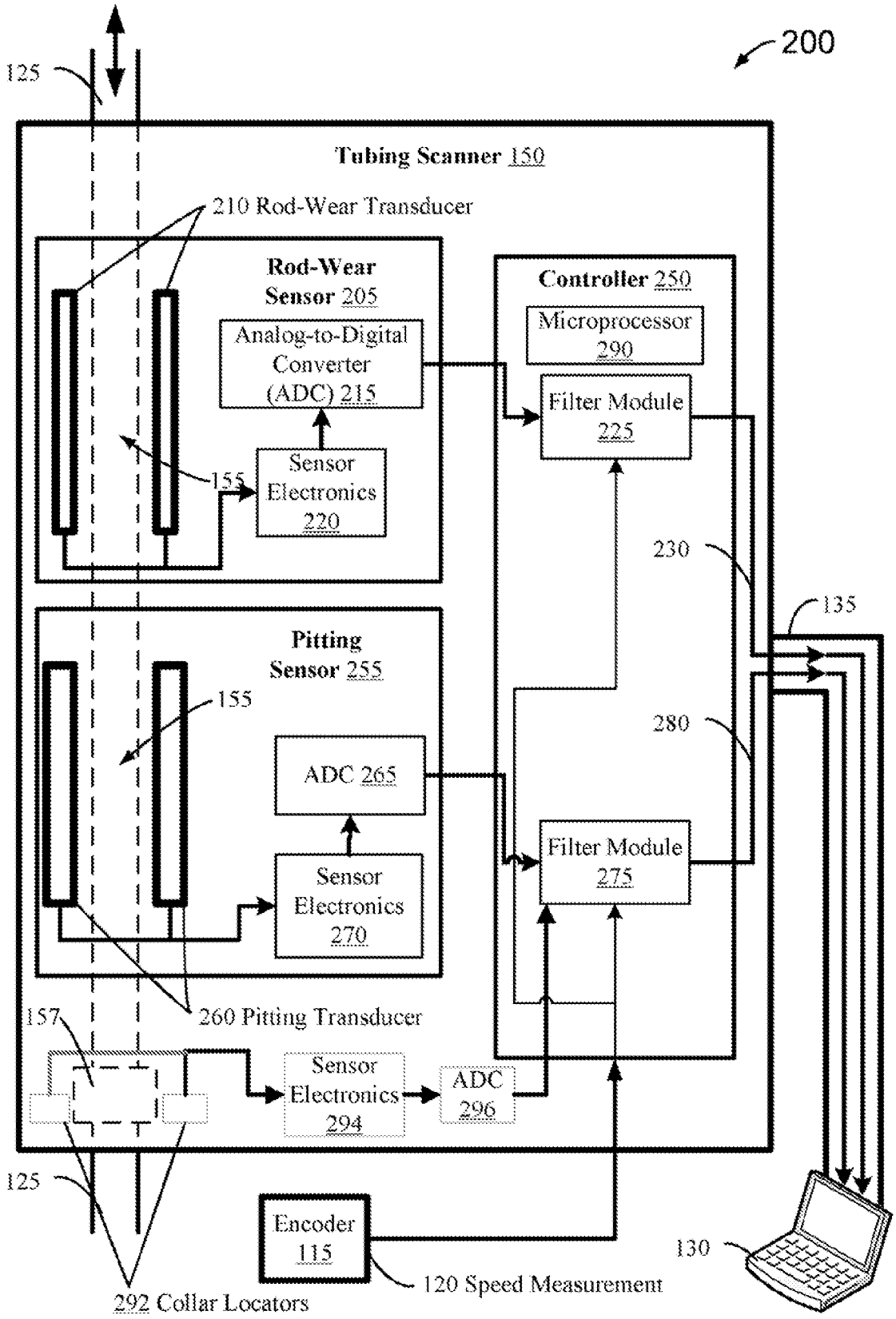
FIG. 2 is a functional block diagram of an exemplary system for scanning tubing that is being inserted into or extracted from an oil well in accordance with one exemplary embodiment of the present invention.

A method and system for retrieving and displaying tubing data will now be described more fully hereinafter with reference to FIGS. 1-11, which show representative embodiments of the present invention. FIG. 1 depicts a workover rig moving tubing through a tubing scanner in a representative operating environment for an embodiment the present invention. FIG. 2 provides a block diagram of a tubing scanner that monitors, senses, or characterizes tubing and flexibly processes the acquired timing data. FIGS. 3-11 show flow diagrams, along with illustrative data and plots, of methods and displays related to acquiring tubing data, processing it and displaying the acquired data.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Moreover, although an exemplary embodiment of the invention is described with respect to sensing or monitoring a tube, tubing, pipe, or collars moving though a measurement zone adjacent to a wellhead, those skilled in the art will recognize that the invention may be employed or utilized in connection with a variety of applications in the oilfield or other operating environments.

Turning now to FIG. 1, this figure illustrates a system 100 for servicing an oil well 175 that scans tubing 125 as the tubing 125 is extracted from or inserted into the well 175 according to an exemplary embodiment of the present invention.

The oil well 175 comprises a hole bored or drilled into the ground to reach an oil-bearing formation. The borehole of the well 175 is encased by a tube or pipe (not explicitly shown in FIG. 1), known as a "casing," that is cemented to down-hole formations and that protects the well 175 from unwanted formation of fluids and debris.

Within the casing is a tube 125 that carries oil, gas, hydrocarbons, petroleum products, and/or other formation fluids, such as water, to the surface. In operation, a sucker rod string (not explicitly shown in FIG. 1), disposed within the tube 125, forces the oil uphole. Driven by strokes from an uphole machine, such as a "rocking" pump jack, the sucker rod moves up and down to communicate reciprocal motion to a downhole pump (not explicitly shown in FIG. 1). With each stroke, the downhole pump moves oil up the tube 125 towards the wellhead.

As shown in FIG. 1, a service crew uses a workover or service rig 140 to service the well 175. During the illustrated procedure, the crew pulls the tubing 125 from the well 175, for example to repair or replace the downhole pump. In one exemplary embodiment, the tubing 125 comprises a string of thirty-foot sections (approximately 9.12 meters per section), each of which may be referred to as a "joint", however, other sizes of tubing 125, both homogeneous and heterogeneous in size may be used. The joints screw together via collars 157.

The crew uses the workover rig 140 to extract the tubing 125 in increments or steps, typically two joints per increment, known as a "section." The rig 140 comprises a derrick or boom 145 and a cable 105 that the crew temporarily fastens to the tubing section 125. A motor-driven reel 110, drum, winch, or block and tackle pulls the cable 105 thereby hoisting or lifting the tubing section 125 attached thereto. The crew lifts the tubing section 125 a vertical distance that approximately equals the height of the derrick 145, approximately sixty feet or two joints.

More specifically, the crew attaches the cable 105 to the tubing section 125, which is vertically stationary during the attachment procedure. The crew then lifts the tubing 125, typically in a continuous motion, so that two joints are extracted from the well 175 while the portion of the tubing section 125 below those two joints remains in the well 175. When those two joints are out of the well 175, the operator of the reel 110 stops the cable 105, thereby halting upward motion of the tubing 125. After the crew pulls a stand of tubing 125, the crew can then set the slips. The crew then separates or unscrews the two exposed joints from the remainder of the tubing section 125 that extends into the well 175.

The crew repeats the process of lifting and separating two-joint sections of tubing 125 from the well 175 and arranges the extracted sections in a stack of vertically disposed joints, known as a "stand" of tubing 125. After extracting the full tubing section 125 from the well 175 and servicing the pump, the crew reverses the step-wise tube-extraction process by placing the tubing sections 125 back in the well 175. In other words, the crew uses the rig 140 to reconstitute the tubing sections 125 by threading or "making up" each joint with collars 157 and incrementally lowering the tubing sections 125 into the well 175.

The system 100 comprises an instrumentation system for monitoring, scanning, assessing, or evaluating the tubing 125 as the tubing 125 moves into or out of the well 175. In another exemplary embodiment, the system 100 is capable of receiving information from other sensors (not shown) including ultrasonic sensors, weight sensors, and weight indicator information for use in displaying the received data, against depth. The instrumentation system comprises a tubing scanner 150 that obtains information or data about the portion of the tubing 125 that is in the scanner's sensing or measurement zone 155. Via a data link 120, an encoder 115 provides the tubing scanner 150 with speed, velocity, and/or positional information about the tubing 125. That is, the encoder 115 is mechanically linked to the drum 110 to determine motion and/or position of the tubing 125 as the tubing 125 moves through the measurement zone 155. In one exemplary embodiment, the slip air pressure can be evaluated to determine if a pressure switch is tripped or activated, the pressure switch signaling whether the computer 130 should ignore the block or encoder 115 movement.

As an alternative to the illustrated encoder 115 some other form of positional or speed sensor can determine the derrick's block speed or the rig engine's rotational velocity in revolutions per minute ("RPM"), for example. Other methods of obtaining speed or positional data include the use of a gelograph, a gelograph line, a measuring wheel riding on the fast line of the cable 105, and a spoke counter on a crown sheave.

Another data link 135 connects the tubing scanner 150 to a computing device, which can be a laptop 130, a handheld, a personal communication device ("PDA"), a cellular system, a portable radio, a personal messaging system, a wireless appliance, or a stationary personal computer ("PC"), for example. The laptop 130 displays data that the tubing scanner 150 has obtained from the tubing 125. The laptop 130 can present tubing data graphically, for example. The service crew monitors or observes the displayed data on the laptop 130 to evaluate the condition of the tubing 125. The service crew can grade the tubing 125 according to its fitness for continued service, for example.

The communication link 135 can comprise a direct link or a portion of a broader communication network that carries information among other devices or similar systems to the system 100. Moreover, the communication link 135 can comprise a path through the Internet, an intranet, a private network, a telephony network, an Internet protocol ("IP") network, a packet-switched network, a circuit-switched network, a local area network ("LAN"), a wide area network ("WAN"), a metropolitan area network ("MAN"), the public switched telephone network ("PSTN"), a wireless network, or a cellular system, for example. The communication link 135 can further comprise a signal path that is optical, fiber optic, wired, wireless, wire-line, waveguided, or satellite-based, to name a few possibilities. Signals transmitted over the link 135 can carry or convey data or information digitally or via analog transmission. Such signals can comprise modulated electrical, optical, microwave, radiofrequency, ultrasonic, or electromagnetic energy, among other energy forms.

The laptop 130 typically comprises hardware and software. That hardware may comprise various computer components, such as disk storage, disk drives, microphones, random access memory ("RAM"), read only memory ("ROM"), one or more microprocessors, power supplies, a video controller, a system bus, a display monitor, a communication interface, and input devices. Further, the laptop 130 can comprise a digital controller, a microprocessor, or some other implementation of digital logic, for examples.

The laptop 130 executes software that may comprise an operating system and one or more software modules for managing data. The operating system can be the software product that Microsoft Corporation of Redmond, Wash. sells under the registered trademark WINDOWS, for example. The data management module can store, sort, and organize data and can also provide a capability for graphing, plotting, charting, or trending data. The data management module can be or comprise the software product that Microsoft Corporation sells under the registered trademark EXCEL, for example.

In one exemplary embodiment of the present invention, a multitasking computer functions as the laptop 130. Multiple programs can execute in an overlapping timeframe or in a manner that appears concurrent or simultaneous to a human observer. Multitasking operation can comprise time slicing or timesharing, for example.

The data management module can comprise one or more computer programs or pieces of computer executable code. To name a few examples, the data management module can comprise one or more of a utility, a module or object of code, a software program, an interactive program, a "plug-in," an "applet," a script, a "scriptlet," an operating system, a browser, an object handler, a standalone program, a language, a program that is not a standalone program, a program that runs a computer 130, a program that performs maintenance or general purpose chores, a program that is launched to enable a machine or human user to interact with data, a program that creates or is used to create another program, and a program that assists a user in the performance of a task such as database interaction, word processing, accounting, or file management.

Turning now to FIG. 2, this figure illustrates a functional block diagram of a system 200 for scanning tubing 125 that is being inserted into or extracted from an oil well 175 according to an exemplary embodiment of the present invention. Thus, the system 200 provides an exemplary embodiment of the instrumentation system shown in FIG. 1 and discussed above, and will be discussed as such.

Those skilled in the information-technology, computing, signal processing, sensor, or electronics arts will recognize that the components and functions that are illustrated as individual blocks in FIG. 2, and referenced as such elsewhere herein, are not necessarily well-defined modules. Furthermore, the contents of each block are not necessarily positioned in one physical location. In one embodiment of the present invention, certain blocks represent virtual modules, and the components, data, and functions may be physically dispersed. Moreover, in some exemplary embodiments, a single physical device may perform two or more functions that FIG. 2 illustrates in two or more distinct blocks. For example, the function of the personal computer 130 can be integrated into the tubing scanner 150 to provide a unitary hardware and software element that acquires and processes data and displays processed data in graphical form for viewing by an operator, technician, or engineer.

The tubing scanner 150 comprises a rod-wear sensor 205 and a pitting sensor 255 for determining parameters relevant to continued use of the tubing 125. The rod-wear sensor 205 assesses relatively large tubing defects or problems such as wail thinning. Wall thinning may be due to physical wear or abrasion between the tubing 125 and the sucker rod that is reciprocated against therein, for example. Meanwhile, the pitting sensor 255 detects or identifies smaller flaws, such as pitting stemming from corrosion or some other form of chemical attack within the well 175. Those small flaws may be visible to the naked eye or microscopic, for example.

The inclusion of the rod-wear sensor 205 and the pitting sensor 225 in the tubing scanner 150 is intended to be illustrative rather than limiting. The tubing scanner 150 can comprise another sensor or measuring apparatus that may be suited to a particular application. For example, the instrumentation system 200 can comprise a collar locator 292, a device that detects tubing cracks or splits, a temperature gauge, etc. In one exemplary embodiment, the collar locators 292 are a magnetic pickup, however other sensors or switches may be used to determine when the collar is passing though at least a portion of the scanning area in the tubing scanner 150.

The tubing scanner 150 also includes a controller 250 that processes signals from the rod-wear sensor 205, the pitting sensor 255, and the collar locator 292. The exemplary controller 250 has two filter modules 225, 275 that each, as discussed in further detail below, adaptively or flexibly processes sensor signals. In one exemplary embodiment, the controller 250 processes signals according to a speed measurement from the encoder 115.

The controller 250 can comprise a computer, a microprocessor 290, a computing device, or some other implementation of programmable or hardwired digital logic. In one exemplary embodiment, the controller 250 comprises one or more application specific integrated circuits ("ASICS") or DSP chips that perform the functions of the filters 225, 275, as discussed below. The filter modules 225, 275 can comprise executable code stored on ROM, programmable ROM ("PROM"), RAM, an optical format, a hard drive, magnetic media, tape, paper, or some other machine readable medium.

The rod-wear sensor 205 comprises a transducer 210 that, as discussed above, outputs an electrical signal containing information about the section of tubing 125 that is in the measurement zone 155. Sensor electronics 220 amplify or condition that output signal and feed the conditioned signal to the ADC 215. The ADC 215 converts the signal into a digital format, typically providing samples or snapshots of the thickness of the portion of the tubing 125 that is situated in the measurement zone 155.

The rod-wear filter module 225 receives the samples or snapshots from the ADC 215 and digitally processes those signals to facilitate machine- or human-based signal interpretation. The communication link 135 carries the digitally processed signals 230 from the rod-wear filter module 225 to the laptop 130 for recording and/or review by one or more members of the service crew. The service crew can observe the processed data to evaluate the tubing 125 for ongoing service.

Similar to the rod-wear sensor 205, the pitting sensor 255 comprises a pitting transducer 260, sensor electronics 270 that amplify the transducer's output, and an ADC 265 for digitizing and/or sampling the amplified signal from the sensor electronics 270. Like the rod-wear filter module 225, the pitting filter module 275 digitally processes measurement samples from the ADC 265 outputs a signal 280 that exhibits improved signal fidelity for display on the laptop 130.

Similar to the rod-wear sensor 205, the collar locator 292 comprises sensor electronics 294 that amplify the locator's output, and an ADC 296 for digitizing and/or sampling the amplified signal from the sensor electronics 294. Like the rod-wear filter module 225, the filter module 275 digitally processes measurement samples from the ADC 296 outputs a signal that exhibits improved signal fidelity for display on the laptop 130.

Each of the transducers 210, 260 generates a stimulus and outputs a signal according to the tubing's 125 response to that stimulus. For example, one of the transducers 210, 260 may generate a magnetic field and detect the tubing's 125 effect or distortion of that field. In one exemplary embodiment, the pitting transducer 260 comprises field coils that generate the magnetic field and hall effect sensors or magnetic "pickup" coils that detect field strength.

In one exemplary embodiment, one of the transducers 210, 260 may output ionizing radiation, such as a gamma rays, incident upon the tubing 125. The tubing 125 blocks or deflects a fraction of the radiation and allows transmission of another portion of the radiation. In this example, one or both of the transducers 210, 260 comprises a detector that outputs an electrical signal with a strength or amplitude that changes according to the number of gamma rays detected. The detector may count individual gamma rays by outputting a discrete signal when a gamma ray interacts with the detector, for example.

Methods for the exemplary embodiments of the present invention will now be discussed with reference to FIGS. 3-11. An exemplary embodiment of the present invention can comprise one or more computer programs or computer-implemented methods that implement functions or steps described herein and illustrated in the exemplary flowcharts, graphs, and data sets of FIGS. 3-9B and the diagrams of FIGS. 1 and 2. However, it should be apparent that there could be many different ways of implementing the invention in computer programming, and the invention should not be construed as limited to any one set of computer program instructions. Further, a skilled programmer would be able to write such a computer program to implement the disclosed invention without difficulty based on the exemplary system architectures, data tables, data plots, and flowcharts and the associated description in the application text, for example.

Therefore, disclosure of a particular set of program code instructions is not considered necessary for an adequate understanding of how to make and use the invention. The inventive functionality of any claimed process, method, or computer program will be explained in more detail in the following description in conjunction with the remaining figures illustrating representative functions and program flow.

Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 3:
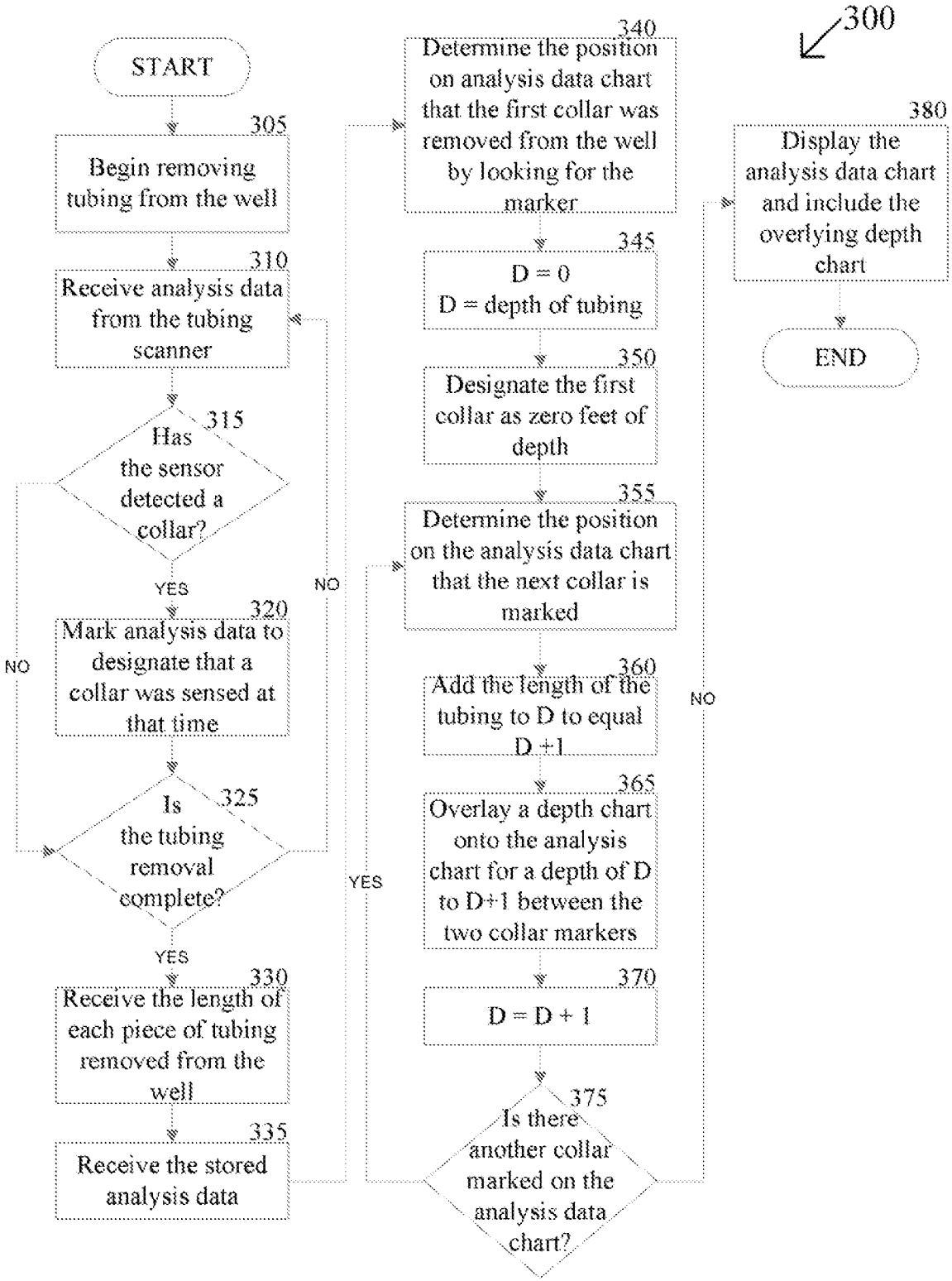
FIG. 3 is a flowchart diagram of an exemplary method for overlaying a display of depth on a analysis data chart based on the position of one or more collars in accordance with one exemplary embodiment of the present invention.

Turning now to FIG. 3, an exemplary process 300 for overlaying a display of depth on an analysis data chart based on the position of the collars 157 is shown and described within the operating environment of the exemplary workover rig 140 and tubing scanner 150 of FIGS. 1 and 2. Now referring to FIGS. 1, 2, and 3, the exemplary method 300 begins at the START step and proceeds to step 305, where the workover rig 140 begins to remove the tubing 125 from the well 175. In step 310, the computer 130 receives analysis data from the tubing scanner 150. In one exemplary embodiment, the computer 130 receives data from the pitting sensors 255 and the rod wear sensors 205.

In step 315, an inquiry is conducted to determine if the collar locators 292 have detected or sensed a collar 157. In one exemplary embodiment, the collar locators 292 detect a collar 157 when the collar 157 is adjacent or nearly adjacent to the collar locators 292. In another exemplary embodiment, the collar 157 can be detected by other sensor within the tubing scanner 150. For example, the sensors 205 or 252 may be used to sense for collars as well as other function because the these sensors 205, 252 tend to register a noticeable signal variation when a collar 157 passes within range of the sensor. In this example, the computer 130 can be programmed to recognize this variation or the operator of the rig 140 may be able to view the variation and register the location of the collar 157 through the computer 130 or other device communicably attached to the computer 130. If the collar locators 292 have detected a collar 157, the "YES" branch is followed to step 320, where the computer 130 marks the analysis data to designate that a collar was detected at that time. The computer 130 can "mark" the analysis data by inserting a figure, text, or symbol that can be later detected in the chart display of the analysis data. In the alternative, the computer 130 can "mark" the analysis data by recording the analysis data in a database, such as in a database table that can accept reference to the collar 157 being detected and associate that table with the time that the analysis data was being retrieved. Further, those of ordinary skill in the art of data retrieval, analysis and manipulation will know of several other methods for signifying that a collar 157 was located at a particular time that analysis data was being received from the tubing scanner 150. The process then continues to step 325.

If the collar locators 292 do not detect a collar 157, the "NO" branch is followed to step 325. In step 325, an inquiry is conducted to determine if the tubing removal process from the well 175 is complete. If the tubing removal process is not complete, the "NO" branch is followed to step 310 to receive additional analysis data and continue defecting collars 157. Otherwise, the "YES" branch is followed to step 330, where the length of the tubing 125 being removed from the well 175 is determined. The tubing length can be input at the computer 130 by an oilfield service operator. Alternatively, the tubing length can be received from analysis completed by the encoder 115 or other positional sensor. In one exemplary embodiment, the tubing 125 has a length of thirty feet. The computer 130 receives the stored analysis data in step 335. In step 340, the computer 130 determines the position in the analysis data that the first collar 157 was removed from the well 175 by looking for the inserted mark.

In step 345, a counter variable D is set equal to zero. The counter variable D represents the depth that the tubing 125 was at within the well 175. The computer 130 designates the first collar 157 marked in the analysis data as zero feet of depth in step 350. In another exemplary embodiment, the depth of the first collar 157 marked in the analysis data can be input and can be other than zero feet. In another exemplary embodiment, positional data can be retrieved from the encoder 115 to determine the depth of the first collar 157. In step 355, the computer 130 analyzes the analysis data to find the mark designating the next collar detected and marked within the analysis data. The computer 130 adds the length of the tubing 125 that was input by the operator or detected by the encoder 115 or other depth device to the current length D in step 360. For example, if the first collar 157 was at zero feet and the tubing 125 is in 30 foot lengths, then the new depth is 30 feet.

The computer 130 displays the analysis data chart and overlays the depth from D to D plus one between the two collar markers in step 365. In step 370, the counter variable D is set equal to D plus one. In step 375, an inquiry is conducted by the computer 130 to determine if there are any additional collars 157 that were marked in the analysis data. If so, the "YES" branch is followed back to step 355, where the computer 130 determines the position of the next collar marker in the analysis data. Otherwise, the "NO" branch is followed to step 380, where the computer 130 displays the analysis data chart with the overlying depth chart. The process then continues to the END step.

Figure 4:
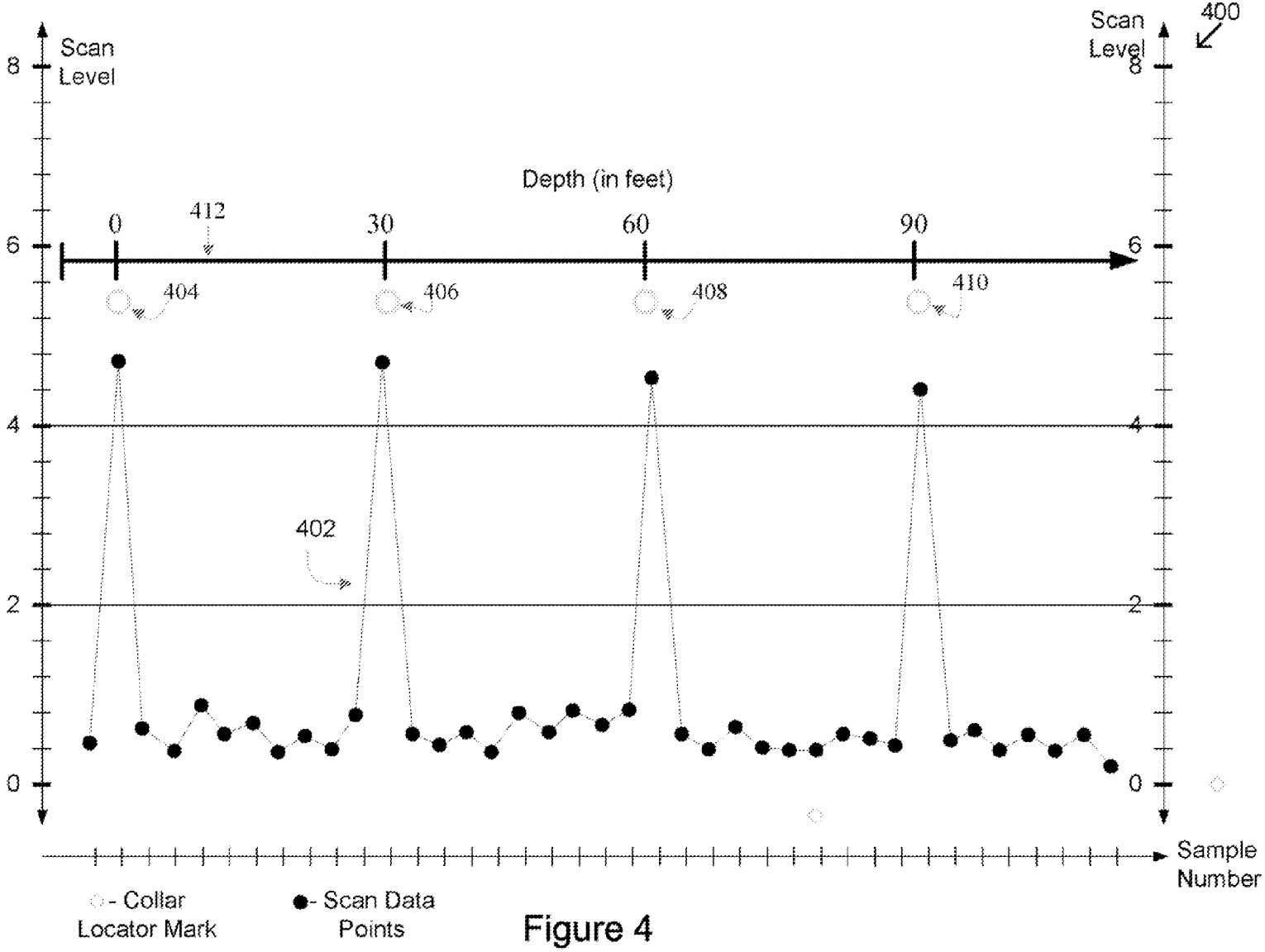
FIG. 4 is an exemplary chart showing the overlay of depth on an analysis data chart based on the position of the collars sensed by a collar locator sensor in accordance with one exemplary embodiment of the present invention.

FIG. 4 provides an exemplary view of the display methods of steps 320 and 340-380 of FIG. 3. Now referring to FIG. 4, the exemplary display of depth data overlying an analysis data chart based on collar position 400 is generated based on an exemplary embodiment where the analysis data is being charted virtually simultaneous to retrieval. The analysis data is shown as scan data points 402 in a line graph. When collars 157 are detected by the collar locators 292 and the information is passed from the collar locators 292 to the computer 130, the computer 130 inserts a mark 404-410. Once the tubing length and the position of the mark 404 representing the first collar 157 detected have been determined, the computer 130 can begin generating the depth scale 412. In the embodiment shown in FIG. 4, the first collar mark 404 was determined to be at a depth of zero feet, however that depth can be adjusted as discussed above. The computer 130 determines the position of the next collar mark 406 and marks the depth by extending the depth scale between the first collar mark 404 and the second collar mark 406 by the amount of the input tubing length. In one exemplary embodiment, the computer 130 could also insert subsets of the tubing length distance into the depth scale. For example, while not shown, the computer 130 could estimate the position of ten feet and twenty feet on this scale to make exact depth easier to determine.

Once the computer 130 has determine the position of the second collar mark 406, depth is set equal to thirty feet and the computer 130 determines the position of the third collar mark 408. A tubing length of thirty feet is added to the distance D to equal a depth of sixty feet and the distance from thirty to sixty-feet is extended between collar marks 406 and 408. The process can be repeated until the last collar mark is reached and the depth scale covers all or substantially all of the analysis data chart 400. As discussed above, the method of display shown in FIG. 4 is only for exemplary purposes. Those of ordinary skill in the art could determine several other methods for marking the data once the collar 157 has been located and displaying the depth data with the analysis data without being outside the scope of this invention.

Figure 5:
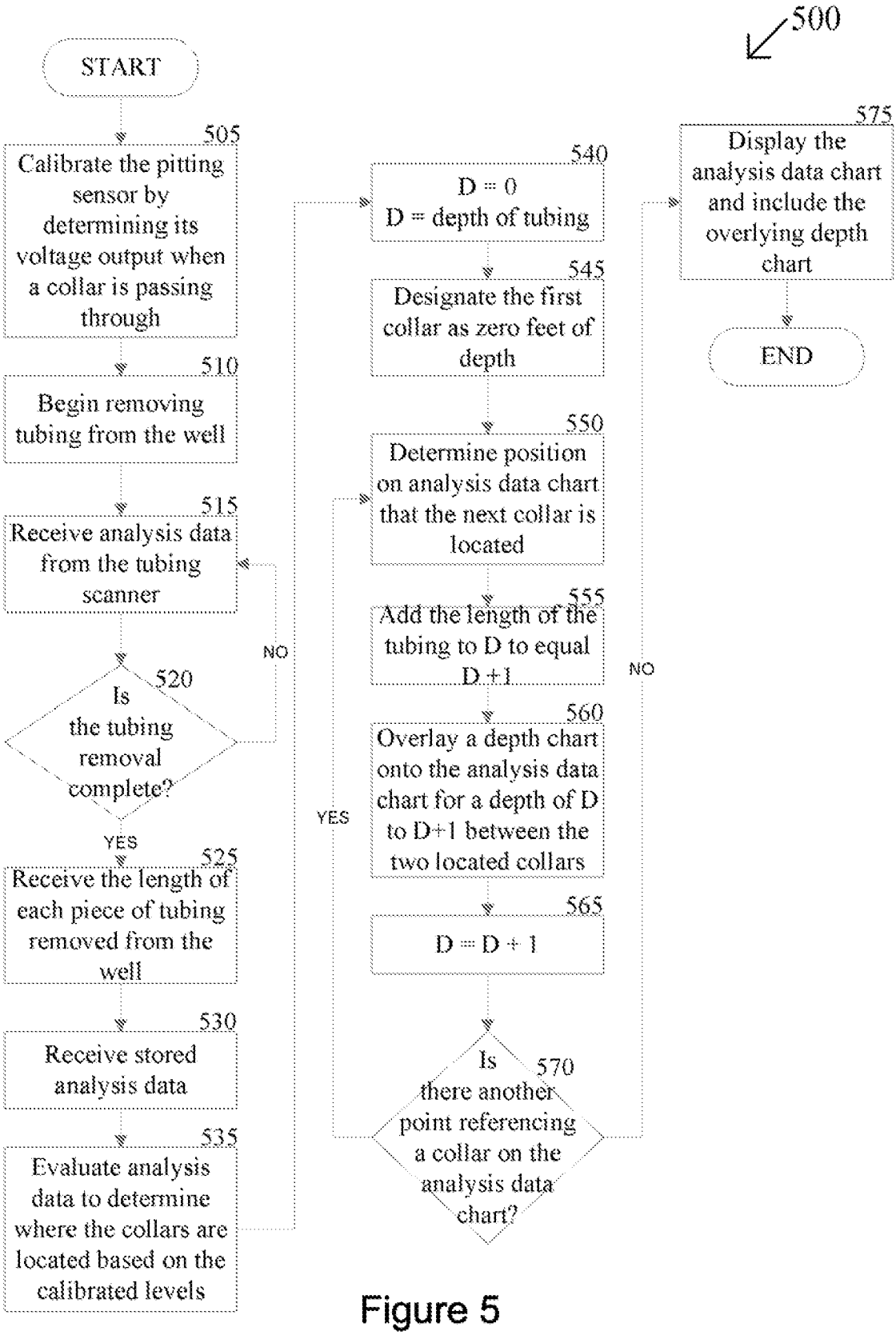
FIG. 5 is a flowchart diagram of another exemplary method for overlaying a display of depth on an analysis data chart by determining collar location based on calibration in accordance with one exemplary embodiment of the present invention.

FIG. 5 is a logical flowchart diagram illustrating another exemplary method 500 for overlaying a display of depth on an analysis data chart based on the position of the collars 157 within the operating environment of the exemplary workover rig 140 and tubing scanner 150 of FIGS. 1 and 2. Mow referring to FIGS. 1, 2, and 5, the exemplary method 500 begins at the START step and proceeds to step 505, where a collar 157 is drawn through the pitting sensors 255 of the tubing scanner 150 to determine a calibrated or standard output by those sensors 255 when the sensors 255 sense a collar 157. In one exemplary embodiment, the collar 157 is drawn through the sensors 255 at or near the same speed that the tubing 125 will be analyzed to improve the acquisition of the scan level from the sensors 255. In another exemplary embodiment other sensors, such as the rod wear sensor 205 or pitting sensor 255 could be used in the calibration and detection of the collars 157. In yet another exemplary embodiment, the computer 130 may be programmed using fuzzy logic, neural networking program logic or other control and learning logic know to those of ordinary skill in the art in order to determine the output parameters of particular sensors when a collar 157 is passing within the sensing range of those sensors. The computer 130 could then calibrate itself to recognize when collars 157 are being sensed by particular sensors in the tubing scanner 150 and input that information into the output tables or charts.

In step 510, the workover rig 140 begins to remove the tubing 125 from the well 175. In step 515, the computer 130 receives analysis data from the tubing scanner 150. In one exemplary embodiment, the computer 130 receives data from the pitting sensors 255 and the rod wear sensors 205. In step 520, an inquiry is conducted to determine if the tubing removal process from the well 175 is complete. If the tubing removal process is not complete, the "NO" branch is followed to step 515 to receive additional analysis data. Otherwise, the "YES" branch is followed to step 525, where the length of the tubing 125 being removed from the well 175 is determined. The tubing length can be input at the computer 130 by an oilfield service operator. Alternatively, the tubing length can be received from analysis completed by the encoder 115, or other positional sensor, and passed to the computer 130. In one exemplary embodiment, the tubing 125 length is thirty feet. The computer 130 receives the stored analysis data in step 530.

In step 535, the computer 130 evaluates the analysis data to determine the location of the collars based on the levels obtained in the calibration procedure of step 505. For example it may be determined during the calibration procedure that the scan level from the pitting sensors 255 is above four when a collar 157 is detected but otherwise it stays below four when tubing 125 with pitting is detected. In this example, the computer 130 would search the analysis data for data sequences above four and would mark these sequences as containing collars. Minor fluctuations in the scan levels could cause the analysis data to go above and below a scan level of four during the analysis phase The computer 130 could also be programmed to evaluate this situation and determine if two collars have been located or one collar having multiple peaks over a scan level of four have been detected.

In step 540, a counter variable D is set equal to zero. The counter variable D represents the depth that the tubing 125 was at within the well 175. The computer 130 designates the first collar 157 located in the analysis data as having a scan level above a predetermined level as zero feet of depth in step 545. In another exemplary embodiment, the depth of the first collar 157 located by the computer 130 in the analysis data can be input and can be other than zero feet. In another exemplary embodiment positional data can be retrieved from the encoder 115 or other positional sensor to determine the depth of the first collar 157. In step 550, the computer 130 analyzes the analysis data to determine the position of the next collar 157 in the analysis data by analyzing the scan levels from the pitting sensor 255. The computer 130 adds the length of the tubing 125 that was input by the operator or detected by the encoder 115 to the current length D in step 555. For example, if the first collar 157 was at zero feet and the tubing 125 is in thirty foot lengths, then the new depth is thirty feet.

The computer 130 displays the analysis data chart and overlays the depth from D to D plus one between the two located collars in step 560. In step 565, the counter variable D is set equal to D plus one. In step 570, an inquiry is conducted by the computer 130 to determine if there is any additional analysis data from the pitting sensors 255 that is associated with a collar 157. If so, the "YES" branch is followed back to step 550. Otherwise, the "NO" branch is followed to step 575, where the computer 130 displays the analysis data chart with the overlying depth chart. The process then continues to the END step.

Figure 6:
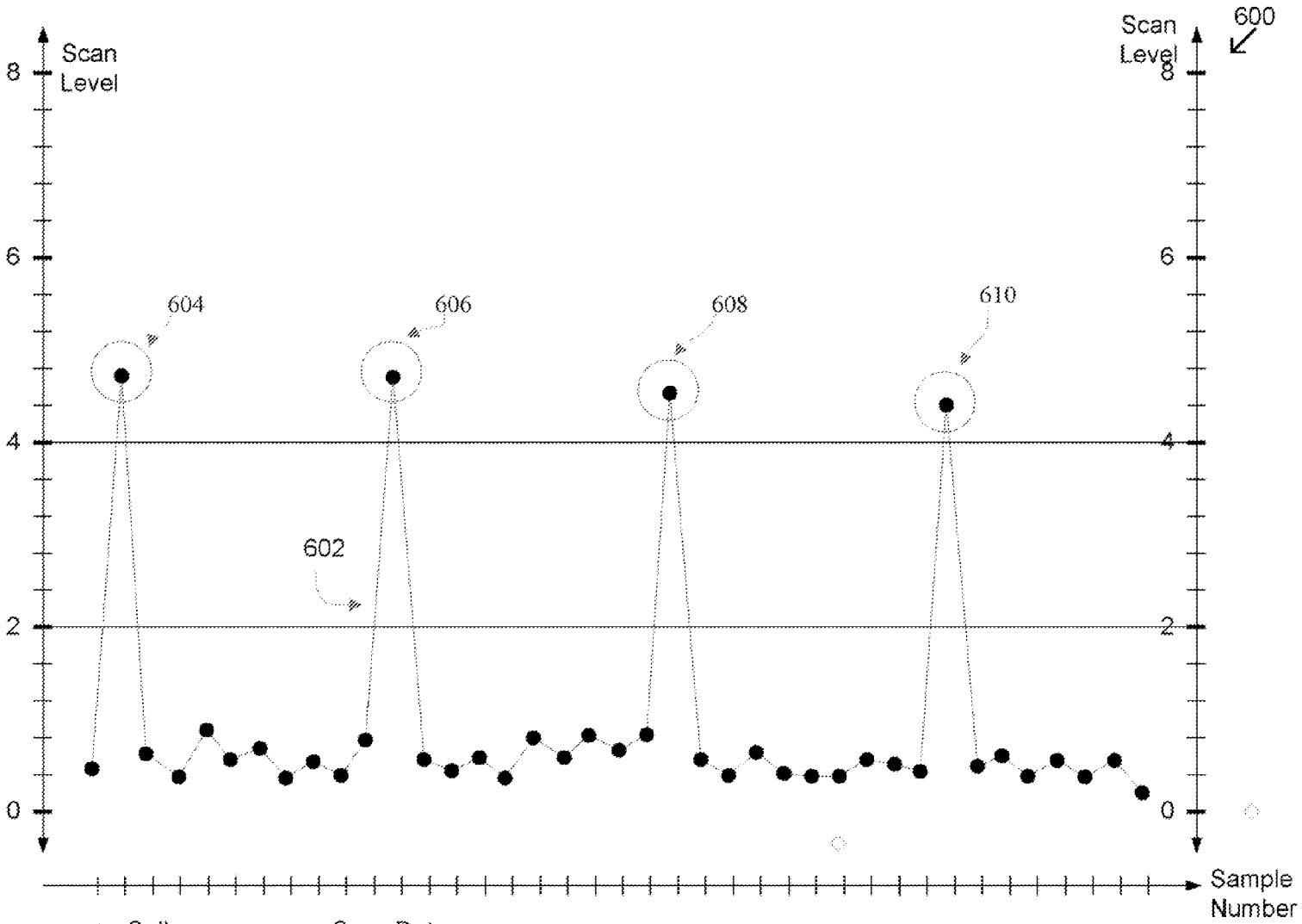
FIGS. 6 and 6A are exemplary charts showing the overlay of depth on an analysis data chart created by determining collar location based on prior calibration in accordance with one exemplary embodiment of the present invention.
Figure 6A:
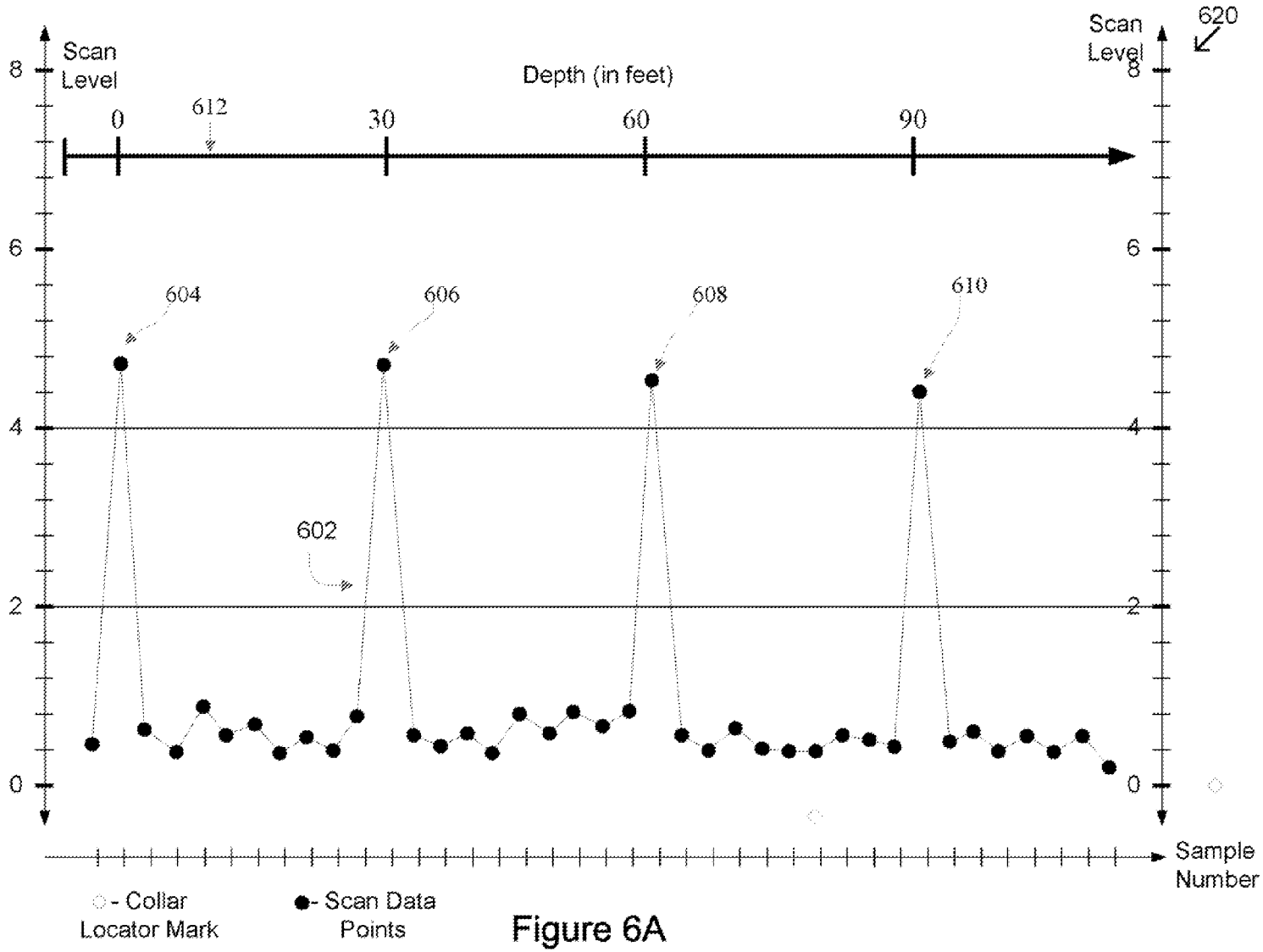

FIGS. 6 and 6A provide exemplary views of the display methods of steps 535-570 of FIG. 5. Now referring to FIGS. 5, 6, and 6A the exemplary display of depth data overlying an analysis data chart based on locating the collars 600 begins with the display of the analysis data from the pitting sensors 255. The analysis data is shown as scan data points 602 in a line graph. For this exemplary display 600 it is assumed that the calibration step of 505 in FIG. 5 revealed that the pitting sensors 255 output a scan level above four when the collar 157 was scanned and less than four when scanning all other parts of the tubing 125. The computer 130 analyzes the scan data 602 to look for data points over a scan level of four.

When the computer 130 reaches the first data point 604 having a scan level over four the computer 130 can record or highlight that data point as being a collar 157. In this exemplary display, the computer 130 associates the first collar 157 as having a depth of zero, but the initial depth of the first collar point 604 can be other than zero, as discussed herein. The computer 130 can analyze the remainder of the analysis data to determine other collar points 606, 608, and 610. Once the tubing length and the position of the first collar point 604 representing the first collar 157 detected have been determined, the computer 130 can begin generating the depth scale.

FIG. 6A provides an exemplary view of the display of the analysis data chart 620 with the depth scale overlying the analysis data. In the embodiment shown in FIG. 6A, the computer 130 determines the position of the next collar point 606 and marks the depth by extending the depth scale between the first collar point 604 and the second collar point 606 by the amount of the input tubing length, thirty feet in this example. In one exemplary embodiment, the computer 130 could also insert subsets of the tubing length distance into the depth scale. For example, while not shown, the computer 130 could estimate the position of ten feet and twenty feet on this scale to make exact depth easier to determine for data points other than the collar points.

Once the computer 130 has determined the position of the second collar data point 606, depth is set equal to thirty and the computer 130 determines the position of the third collar data point 606. A tubing length of thirty is added to the distance to equal a depth of sixty feet and the distance from thirty to sixty feet is extended between collar data points 606 and 608. The process can be repeated until the last collar data point is reached and the depth scale covers all or substantially all of the analysis data chart 620. As discussed above, the method of display shown in FIGS. 6 and 6A is only for exemplary purposes. Those of ordinary skill in the art could determine several other methods for calibrating the sensors and determining the position of the collars based on the scan data and then, once the collars 157 had been located, display the depth data with the analysis data without being outside the scope of this invention. For example, in another exemplary embodiment, the analysis data and the depth data could be displayed on a vertically oriented chart instead of the horizontally oriented chart shown in FIGS. 6 and 6A.

Figure 7:
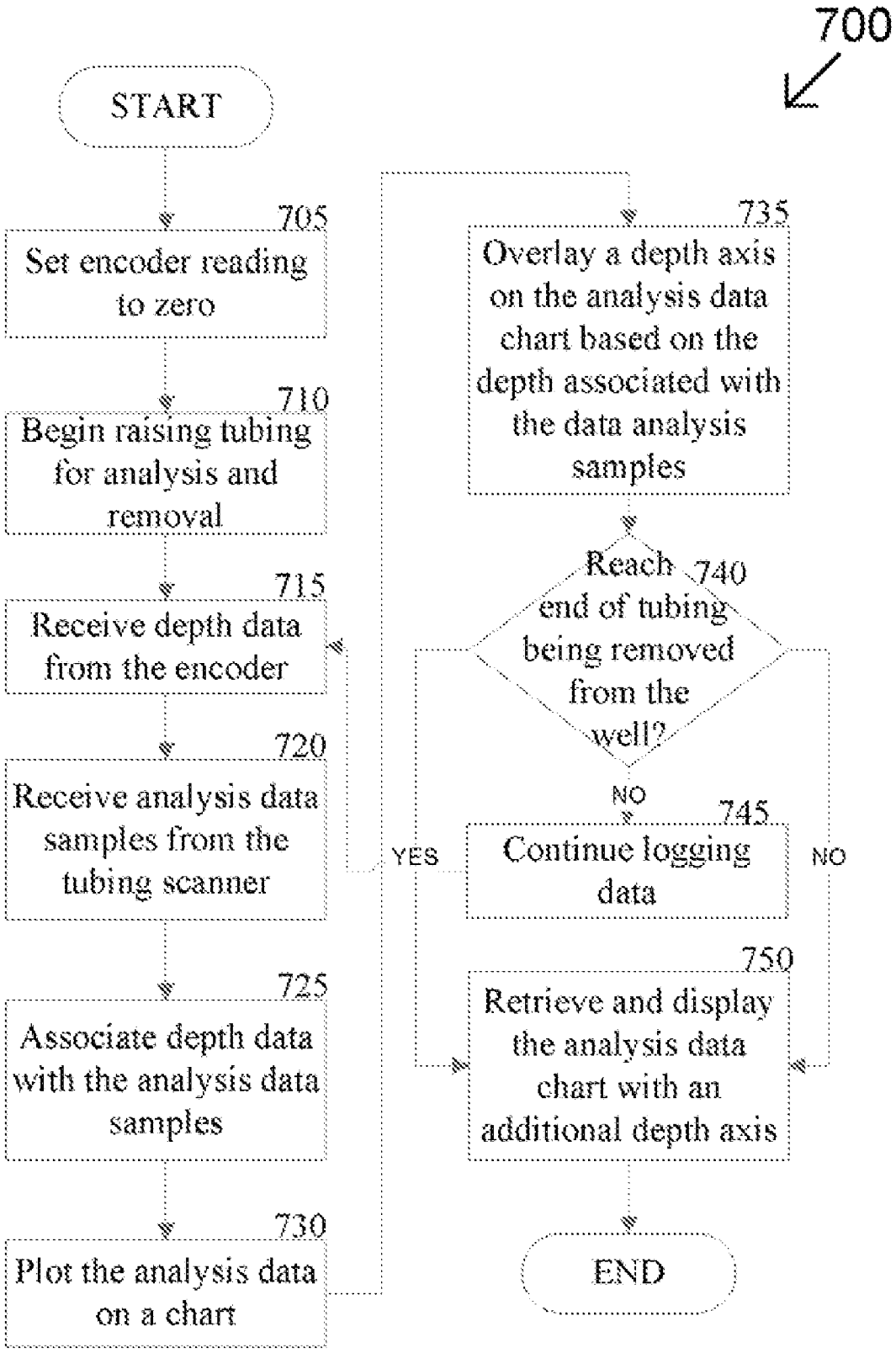
FIG. 7 is a flowchart diagram of an exemplary method for associating analysis data with the depth of the tubing that the analysis data was obtained from and displaying the analysis data with a depth component in accordance with one exemplary embodiment of the present invention.

FIG. 7 is a logical flowchart diagram illustrating an exemplary method 700 for associating analysis data with the depth of the tubing 125 that the analysis data was obtained from and displaying the analysis data with a depth component within the exemplary operating environment of the workover rig 140 of FIG. 1 and the tubing scanner 150 of FIG. 2. Referencing FIGS. 1, 2, and 7, the exemplary method 700 begins at the START step and proceeds to step 705, where the encoder 115 reading at the computer 130 is set equal to zero. In step 710, the workover rig 140 begins raising the tubing 125 from the well 175. The computer 130 receives positional or depth data from the encoder 115 or other positional sensor in step 715. In step 720, the computer 130 receives analysis data samples from the sensors 205, 255, 292 in the tubing scanner 150. In step 725, the computer 130 associates the depth data from the encoder 115 with the analysis data samples. In one exemplary embodiment, each time the computer 130 receives an analysis data sample and stores it in a data table, the computer 130 also receives a depth reading from the encoder 115 and places that data in a corresponding data table.

The computer 130 plots the analysis data on a chart and displays it on a view screen for the oilfield service operator in step 730. In step 735, the computer 130 overlays a depth axis on the analysis data chart based on the depth associated with each data analysis sample in the data tables. In step 740, an inquiry is conducted to determine if all of the tubing 125 has been removed from the well 175. If additional tubing 125 needs to be removed, the "YES" branch is followed to step 745, where the computer 130 continues to log the data received from the encoder 115 and the tubing scanner 150. Otherwise, the "NO" branch is followed to step 750, where the computer 130 retrieves and displays the analysis data chart with an overlying depth component. The process then continues to the END step.

Figure 8:
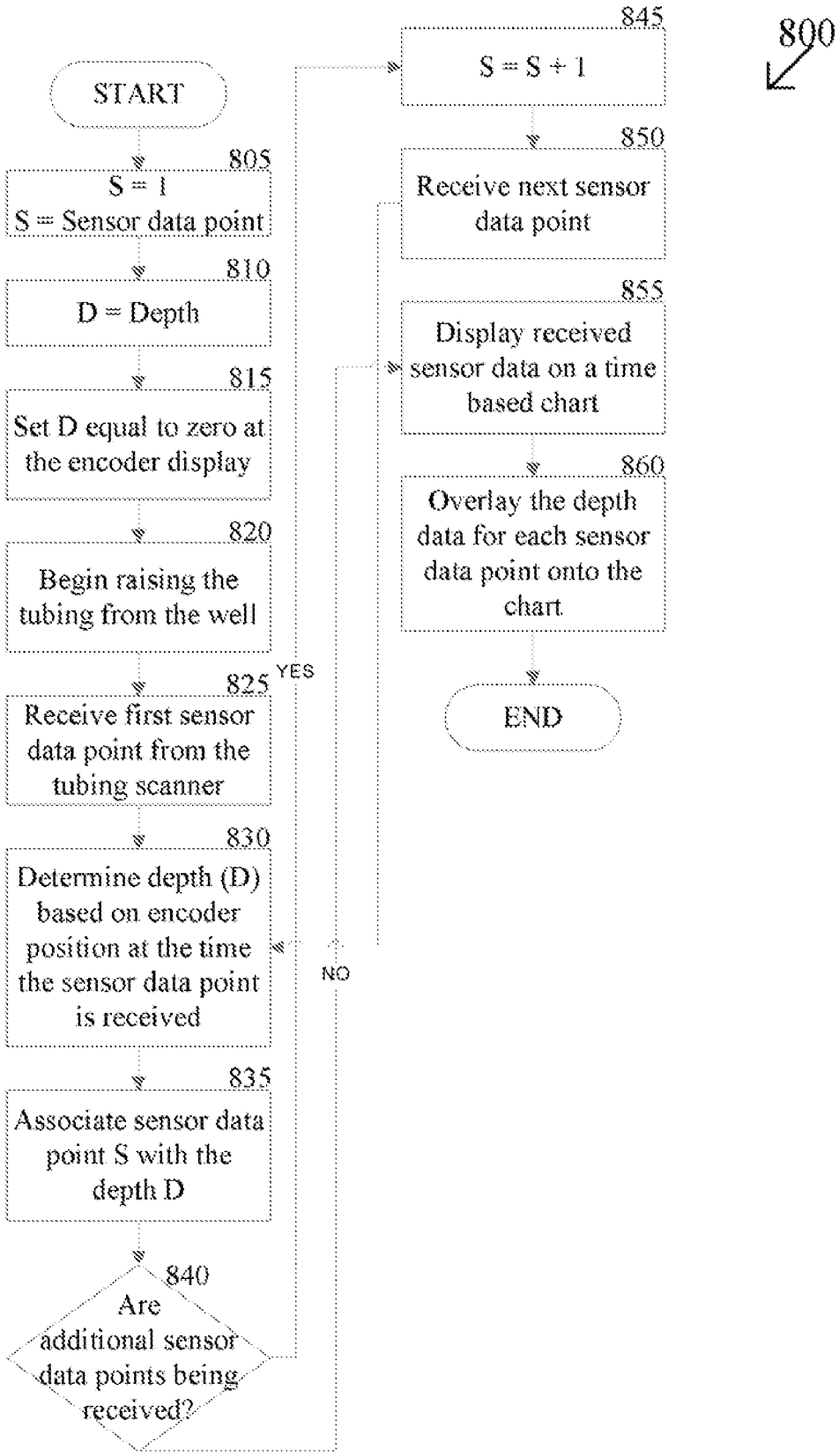
FIG. 8 is a flowchart diagram of another exemplary method for associating analysis data with the depth of the tubing that the analysis data was obtained from and displaying the analysis data with a depth component in accordance with one exemplary embodiment of the present invention.

FIG. 8 is a logical flowchart diagram illustrating another exemplary method 800 for associating analysis data with the depth of the tubing 125 that the analysis data was obtained from and displaying the analysis data with a depth component within the exemplary operating environment of the workover rig 140 of FIG. 1 and the tubing scanner 150 of FIG. 2. Referencing FIGS. 1, 2, and 8, the exemplary method 800 begins at the START step and proceeds to step 805, where counter variable S is set equal to one. Counter variable S represents a sensor data point that can be received from the tubing scanner 150 and displayed on the analysis data chart. In step 810, variable D represents the depth of the tubing 125 retrieved from the well 175. In one exemplary embodiment variable D represents the depth of the tubing 125 as it was positioned in the operating well 175 and not the variable position of each tubing section 125 as it is being removed from the well 175.

In step 815, the variable D is set equal to zero. In one exemplary embodiment, the depth can be set equal to zero at an encoder display on the computer 130. In another exemplary embodiment, the encoder display can be located on the workover rig 140 and the computer 130 can receive and analyze the depth data form that encoder display through the use of communication means known to those of ordinary skill in the art. The workover rig 140 begins removing the tubing 125 from the well 175 in step 820. In step 825, the computer 130 receives the first sensor data point S from the tubing scanner 150. In one exemplary embodiment the data point can be from the pitting sensor 255, the rod wear sensor 205, the collar locators 292 or other sensors added to the tubing scanner 150. In step 830 the computer 130 determines the depth D based on the encoder 115 position and display at the time the sensor data point is received. In one exemplary embodiment, the delay caused by the data from the tubing scanner 150 reaching and being processed by the computer 130 can be more or less than one foot. In this exemplary embodiment, the computer 130 can account for the delay and modify the current data received from the encoder 115 to overcome this delay and equate the depth with the position along the tubing 125 that the data was retrieved from.

In step 835, the computer 130 associates sensor data point S with depth D. In one exemplary embodiment, the association is made by creating and inserting the associated data into data tables which can later be used to generate the analysis data chart and the overlying depth chart. In step 840, and inquiry is conducted by the computer 130 to determine if additional sensor data points S are being received from the tubing scanner 150. If so, the "YES" branch is followed to step 845, where the counter variable S is incremented by one. In step 850, the computer 130 receives the next sensor data point S and the process returns to step 830 to determine the depth for that sensor data point. Returning to step 840, if no additional sensor data points are being received, the "NO" branch is followed to step 855, where the computer 130 displays the received sensor data on a time or samples based chart. In step 860, the computer 130 overlays the depth data associated with each sensor data point onto the analysis data chart. The process then continues to the END step.

Figure 9:
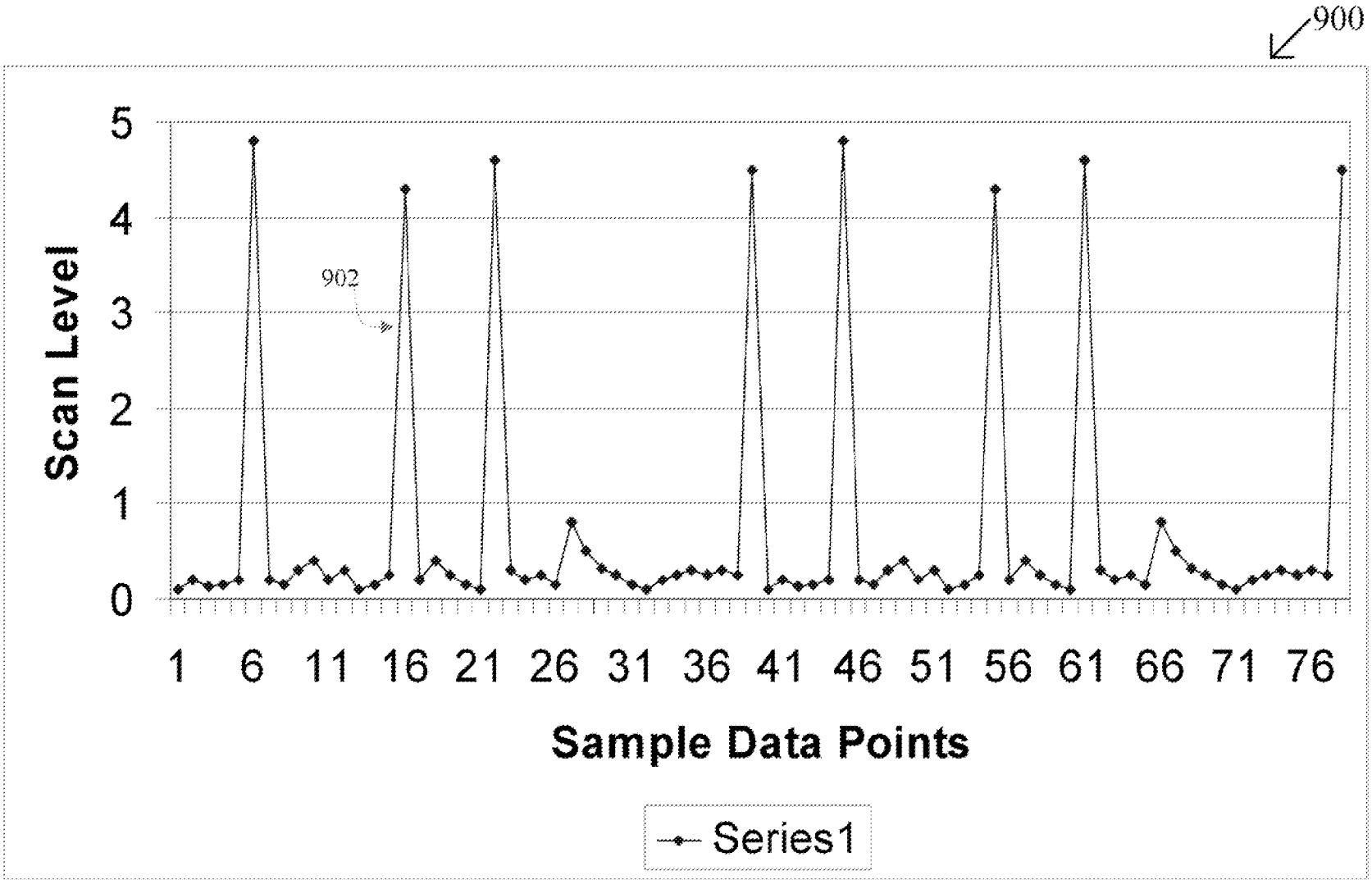
Figure 9A:
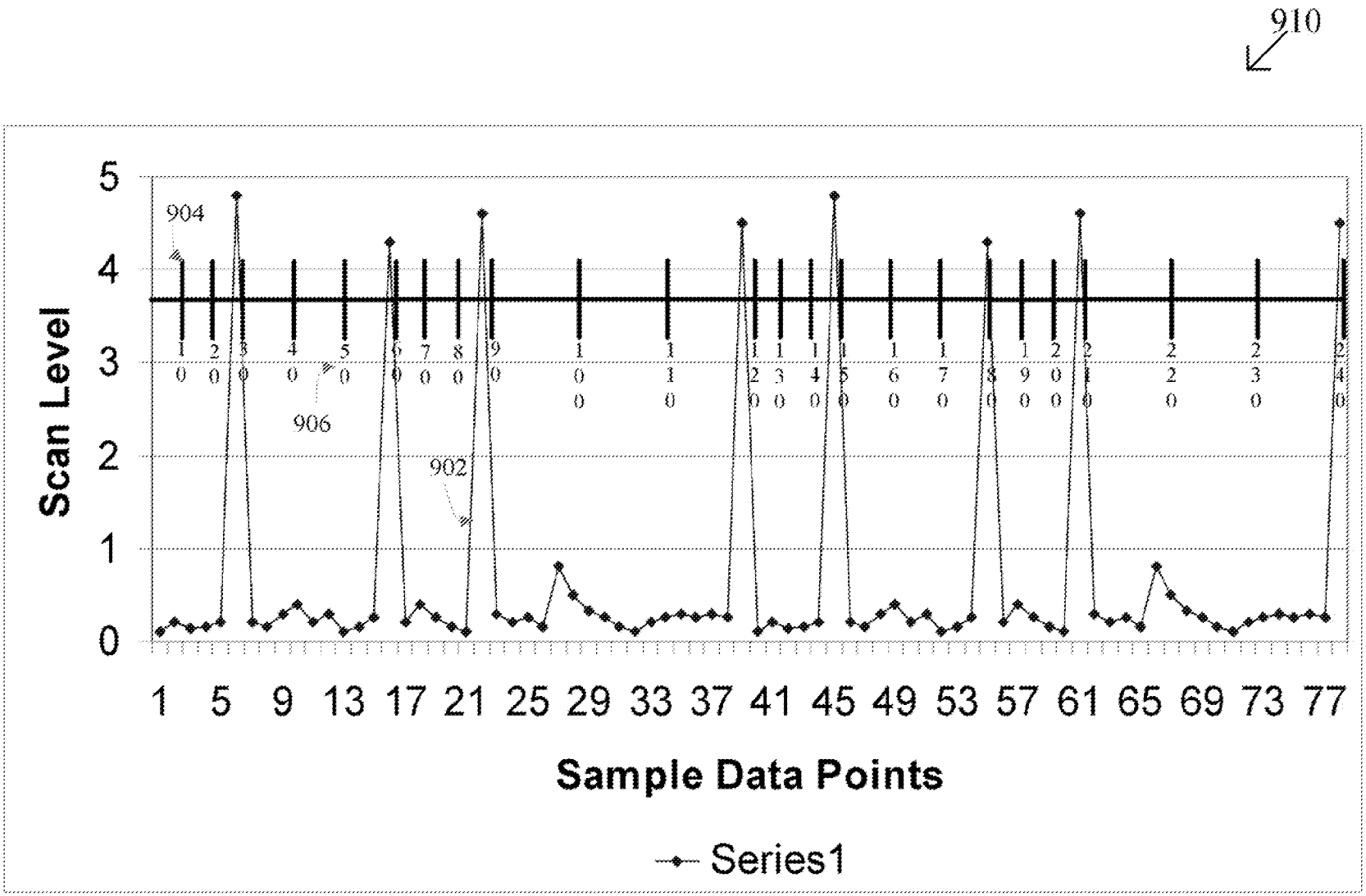

FIGS. 9, 9A, and 9B provide an exemplary view of steps 835-860 of FIG. 8. Now referring to FIGS. 9, 9A, and 9B, the exemplary data analysis display 900 of FIG. 9 includes a y-axis representing the scan level received from the sensors in the tubing scanner 150, an x-axis representing the sample count for the samples received from the tubing scanner 150, and analysis data 902 that could be from any sensor in the tubing scanner 150. FIG. 9B provides an exemplary database table 920 that includes a data sample counter 922, designated "sensor data point counter S"; the scan level 924 for each data point, designated "data value"; a position or depth value counter 926, designated "position counter (D)"; and the depth as received by the computer 130 from the encoder display, in feet. The exemplary database table 920 provides only one of numerous ways to associate the depth data from the encoder display to the scan data points as described in FIG. 8.

FIG. 9A provides an exemplary data analysis display 910 that includes the y-axis representing the scan level received from the sensors in the tubing scanner 150, the x-axis representing the sample count for the samples received from the tubing scanner 150 and analysis data 902, shown as a line graph of data points, that could be from any sensor in the tubing scanner 150 from exemplary display 900 of FIG. 9. Exemplary display 910 further includes an overlying depth axis 904. The position of the depth axis 904 can be easily modified in other exemplary embodiments. Furthermore, the display as a whole could be positioned vertically instead of horizontally as shown in exemplary displays 900 and 910. The exemplary depth axis 904 is achieved by retrieving the associated depth data 928 for each data point 924 in the database table 920 and scaling the depth axis 904 to equal the position of each data point. Those of ordinary skill in the art will recognize that the novelty of displaying the depth data associated with each data point can be achieved in many other ways without frilling outside the scope of this invention. Furthermore, those of skill in the art will recognize that the detail provided in the depth axis 904 is easily adjustable based on the preferences of the oilfield service operator and the amount of detail needed to assist the oilfield service operators in making decisions about the well 175.

Figure 10:
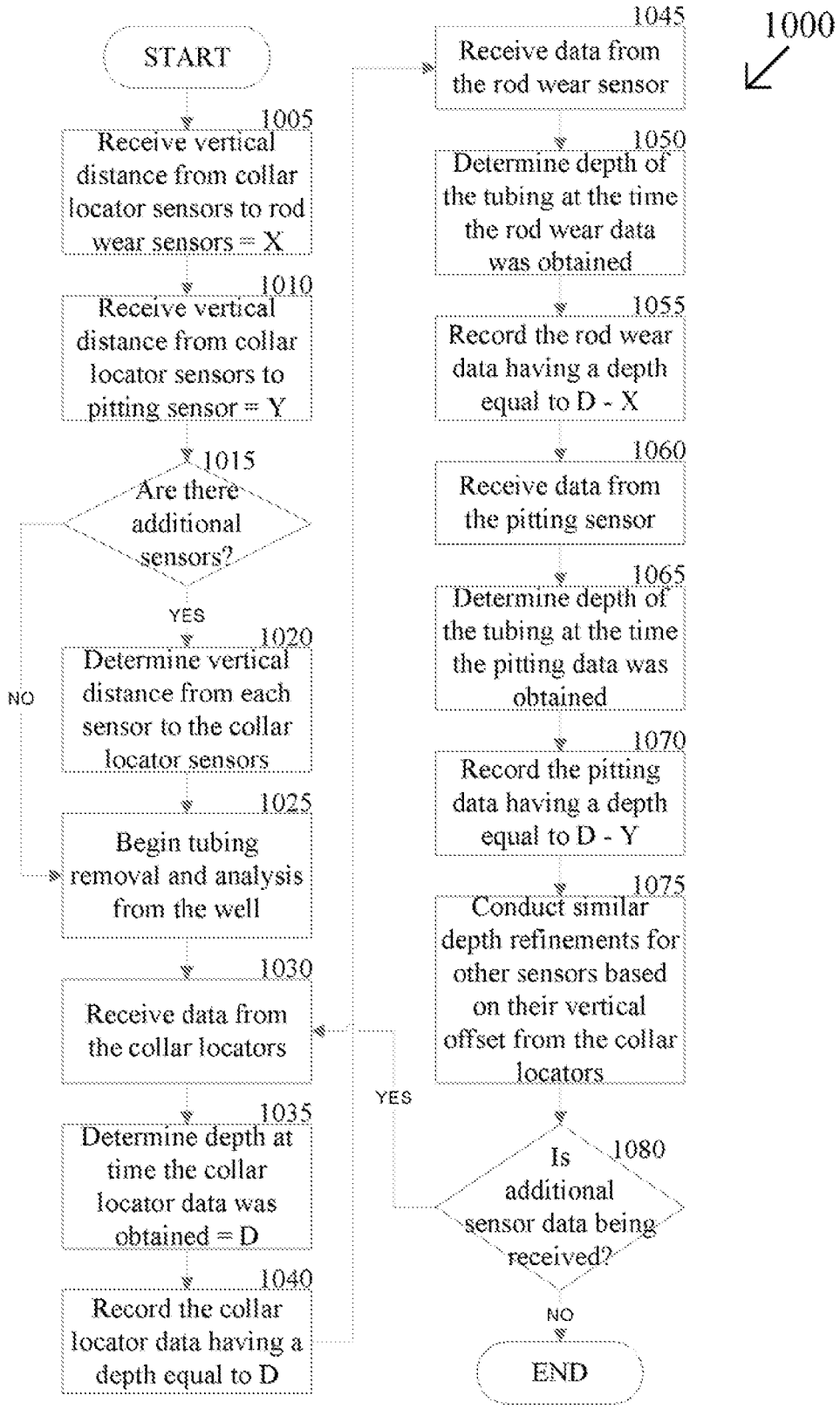
FIG. 10 is a flowchart diagram of an exemplary method for calibrating the tubing data received from several sensors to a specific depth in accordance with one exemplary embodiment of the present invention.

FIG. 10 is a logical flowchart diagram illustrating an exemplary method 1000 for calibrating the tubing data received from several sensors to a specific depth within the exemplary operating environment of the workover rig 140 of FIG. 1 and the tubing scanner 150 of FIG. 2. Referencing FIGS. 1, 2, and 10, the exemplary method 1000 begins at the START step and proceeds to step 1005, where the computer 130 receives the vertical distance from the collar locator 292 to the rod wear sensors 205, that distance being represented by the variable X. In step 1010, the computer 130 receives the vertical distance from the collar locator 292 to the pitting sensor 255 and represents that distance with variable Y. In one exemplary embodiment, the collar locators 292 are considered the base point for all depth positions, however those of ordinary skill in the art could designate other sensors or other points within or outside of the tubing scanner 150 to be the base reference for depth.

In step 1015, an inquiry is conducted to determine if there are additional sensors. These additional sensors may be located in or outside of the tubing scanner 150 and may evaluate a range of information related to tubing 125 and the well 175, including weight sensors, known to those of skill in the art. If there are additional sensors, the "YES" branch is followed to step 1020, where the vertical distance from each sensor to the collar locator 292 is determined and received by or input into the computer 130. Otherwise, the "NO" branch is followed to step 1025. In step 1025, the rig 140 begins the tubing 125 removal process.

The computer 130 or other analysis device receives data from the collar locators 292 in step 1030. In step 1035, the depth of the tubing 125 at the time the collar locator data was obtained is determined. This depth is recorded as variable D. The depth is not the depth of the tubing at the time it passes the collar locators. Instead, the depth is an estimate of the depth at which that portion of tubing 125 is located in the well 175 during the well's operation. The depth can be determined from the encoder 115 or other depth of positional sensors known to those of skill in the art. In step 1040, the computer 130 records the collar locator data as having a depth equal to D. The depth can be recorded in a database table or on a chart displaying real-time data for analysis by an oilfield service operator, or it can be recorded in another manner known to those of ordinary skill in the art. For instance, the data may be directly inserted into a spreadsheet.

In step 1045, the computer 130 receives data from the rod wear sensor 205. In step 1050, the depth of the tubing 125 at the time the rod wear data was obtained is determined. This depth is recorded as variable D. In step 1055, the computer 130 records the rod wear data as having a depth equal to D minus X. In step 1060, the computer 130 receives data from the pitting sensor 255. In step 1065, the depth of the tubing 125 at the time the pitting sensor data was obtained is determined. This depth is recorded as variable D. In step 1070, the computer 130 records the pitting sensor data as having a depth equal to D minus Y. Those of ordinary skill in the art will recognize that the depth variance to the base depth reference could be positive or negative based on relative position to the base reference and for that reason the computer 130 could also add the variance to the determined depth D if the relational position of the sensor to the base reference required it.

In step 1075, the system conducts similar depth refinements for other sensors based on their vertical offset from the collar locators 292. In step 1080, an inquiry is conducted to determine if additional sensor data is being received. If so, the "YES" branch is followed to step 1030. Otherwise, the "NO" branch is followed to the END step.

Figure 11:
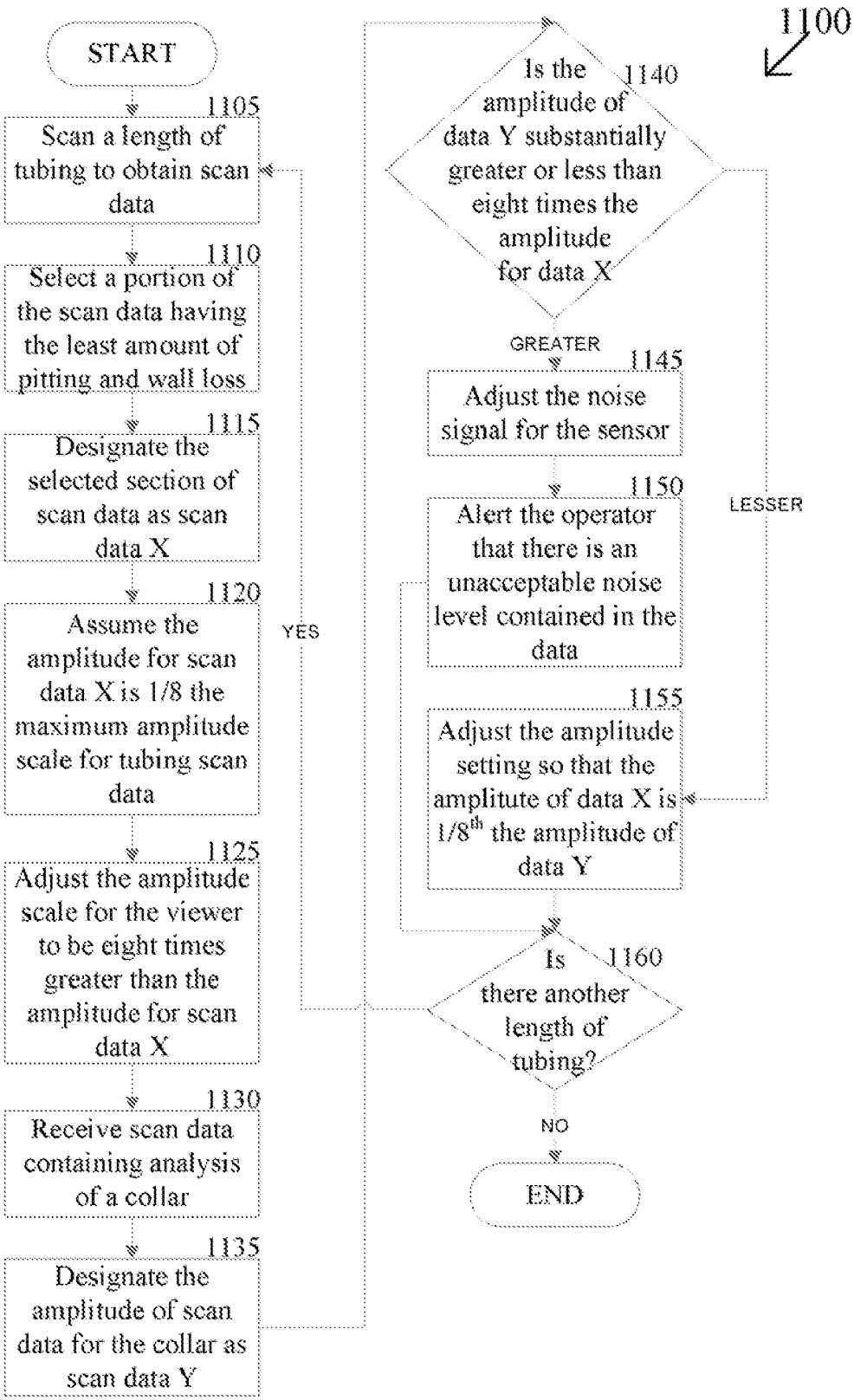
FIG. 11 is a flowchart diagram of an exemplary method for calibrating the amplitude of the tubing data received from the sensors in accordance with one exemplary embodiment of the present invention.

FIG. 11 is a logical flowchart diagram illustrating an exemplary method 1100 for calibrating the amplitude of the tubing data received from several sensors within the exemplary operating environment of the workover rig 140 of FIG. 1 and the tubing scanner 150 of FIG. 2. Referencing FIGS. 1, 2, and 11, the exemplary method 1100 begins at the START step and proceeds to step 1105, where the timing scanner 150 scans a length of tubing 125 to obtain scan data. This scan data can be transmitted to the computer 130 or other analysis device, in one exemplary embodiment. In step 1010, the computer 130 evaluates the scan data for the piece of tubing 125 and selects a portion of the scan data having the least amount of pitting and wall loss. In one exemplary embodiment, the computer 130 selects data representing a five foot length of tubing 125. The selection of the scan data having the least amount of pitting can be accomplished by selecting the data having the smallest maximum peak amplitude, selecting the data having the smaller average amplitude or other analysis methods known to those of skill in the art.

The computer 130 designates the selected section of data as "scan data X" in step 1115. In step 1120, an assumption is input or programmed into the computer 130 regarding the ratio of the amplitude for scan data X to the amplitude of scan data for the entire length of tubing. In one exemplary embodiment, the programmed ratio is scan data X having approximately one-eighth the amplitude of the scale for the chart used to view the scan data and analyze the timing 125. In step 1125, the amplitude scale for the viewable portion of the chart for each sensor displayed on the computer 130 or other display device is set equal to eight times the amplitude for scan data X.

In step 1130, the computer 130 receives scan data from one or more of the sensors containing analysis of a collar 157. In one exemplary embodiment, the collar portion has been noted as significant because it often generates the strongest signal for many of the sensors. However, those of ordinary skill in the art will recognize that other objects may generate the strongest signal for a sensor an those objects could be used as the measuring point discussed in the following steps. The computer 130 designates the amplitude of scan data for the collar 157 as scan data Y. In step 1140, an inquiry is conducted to determine if the amplitude of scan data Y is substantially greater than or less than the amplitude for scan data X. The variance from substantially lesser or greater to exactly equal to eight times the amount can be programmed into the computer 130 based on the current environmental conditions, the sensors being evaluated, and the type of tubing or other material being analyzed. If the amplitude is substantially greater, the "GREATER" branch is followed to step 1145, where the noise signal for the sensor is adjusted. In one exemplary embodiment, the noise signal is manually adjusted by an operator, however the signal could be automatically adjusted by the computer 130 or other control device. In step 1150, an alert is sent to the oilfield service operator that there is an unacceptable noise level contained in the data for at least one sensor. In one exemplary embodiment, this alert may include an audible signal, a visual signal (such as a flashing light), a message displayed on the computer 130 or other display device, an electronic page or electronic mail. The process then continues to step 1160.

Returning to step 1140, if the amplitude is substantially less, then the "LESSER" branch is followed to step 1155, where the amplitude setting for the data or chart display is adjusted to increase the level of the displayed sensor data in the viewable area of the display on the computer 130. In step 1160, an inquiry is conducted to determine if there is another length of tubing 125 than needs to be analyzed by tubing scanner 150. If so, the "YES" branch is followed to step 1105 to begin scanning the next length of tubing. Otherwise, the "NO" branch is followed to the END step. Those of ordinary skill in the art will recognize that the method described in FIG. 11 allows for continuous calibration of the tubing sensors and the display of the data from those sensors during the removal of tubing 125 from the well 175.

In summary, an exemplary embodiment of the present invention describes methods and apparatus for displaying tubing analysis data, determining the location of collars between individual pieces of tubing and displaying a depth or positional component with the analysis data chart. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art.

What is claimed:

1. A method for evaluating tubing data from at least one of a plurality of tubing segments at a wellsite comprising a well, comprising:

moving the plurality of tubing segments into or out of the well;

analyzing the tubing segments with a tubing scanner, said scanner generating a first signal associated with the condition of said tubing segments;

determining the location of a plurality of pipe collars;

determining the length of each tubing segment;

producing an analysis data chart based on the first signal and the location of the plurality of pipe collars;

producing a depth chart based on the location of the plurality of pipe collars and the length of each tubing segment;

overlaying the depth chart onto the analysis data chart for correlating a relative position of each tubing segment to the first signal; and displaying the correlated tubing scanner data and tubing segment positional data.

2. The method of claim 1, wherein said scanner comprises a sensor selected from a wall-thickness sensor, a rod-wear sensor, a collar locating sensor, a crack sensor, an imaging sensor or a pitting sensor.

3. The method of claim 1 further comprising locating the collars with a collar sensor.

4. The method of claim 1, wherein the first signal is transmitted to a computing device.

5. The method of claim 1 wherein the length of the tubing segment is determined by correlating positional data from an encoder and the location of the collars.

6. The method of claim 1 wherein the length of tubing is input by an operator.

7. The method of claim 1 further comprising transmitting the correlated tubing scanner and tubing segment positional data to a location remote from the wellsite.

8. The method of claim 1 wherein the tubing segment positional data includes the depth of the tubing segments.

9. The method of claim 1 further comprising marking the first detected collar as zero depth.

10. The method of claim 1 wherein the tubing segment positional data includes the depth of the tubing segment in the well.

11. The method of claim 1 wherein the scanner data is used to evaluate the tubing segments for defects, integrity, wear, anomalous conditions, or fitness for continued service.

12. A method for evaluating tubing data from at least one of a plurality of tubing segments at a wellsite comprising a well, comprising:

accepting a standard output for a sensor when a pipe collar is scanned;

moving the plurality of tubing segments into or out of the well;

scanning the tubing segments with the sensor as the tubing segments are being moved into or out of the well;

receiving tubing data from the sensor;

evaluating the tubing data to determine the location of the plurality of pipe collars on the tubing segments based on a comparison to the standard output;

determining a length of each tubing segment;

correlating a relative position of each tubing segment to the tubing data; and displaying the correlated tubing scanner data and tubing segment positional data on a display device.

13. The method of claim 12, wherein the sensor is selected from a wall-thickness sensor, a rod-wear sensor, a collar locating sensor, a crack sensor, an imaging sensor, or a pitting sensor.

14. The method of claim 12, wherein the tubing data is transmitted to a computing device.

15. The method of claim 12, wherein the length of the tubing segment is determined by correlating positional data from an encoder and the location of the collars.

16. The method of claim 12, wherein the length of the tubing segment is received at a computer at the wellsite.

17. The method of claim 12 further comprising the step of transmitting the correlated tubing scanner and tubing segment positional data to a location remote from the wellsite.

18. The method of claim 12, wherein the tubing segment positional data comprises the depth of the tubing segments.

19. The method of claim 12, wherein accepting the standard output for the sensor when the pipe collar is scanned comprises the step of calibrating the sensor to produce the standard output when the pipe collar is scanned.

20. The method of claim 12 further comprising the step of marking the first detected collar as zero depth.

21. The method of claim 12 further comprising the step of generating an analysis data chart based on the tubing data and the location of each of the plurality of pipe collars.

22. The method of claim 21 further comprising the step of generating a depth chart based on the location of the plurality of pipe collars and the length of each tubing segment.

23. The method of claim 22 further comprising the step of overlaying the depth chart onto the analysis data chart for correlating the relative position of each tubing segment to the tubing data.

24. A method for evaluating tubing data from at least one of a plurality of tubing segments at a wellsite comprising a well, comprising:

moving a plurality of tubing segments into or out of the well;

scanning the tubing segments with a sensor as the tubing segments are being moved into or out of the well;

receiving tubing data from the sensor;

generating a tubing data chart comprising the tubing data for at least a portion of the plurality of tubing segments;

determining a depth of each tubing segment within the well;

generating a depth chart comprising the depth of each tubing segment within the well;

generating a combined chart comprising an overlay of the depth chart onto the tubing data chart; and displaying the combined chart on a display.

25. A method for calibrating data from a plurality of sensors disposed at different positions, for evaluating tubing from a well at a wellsite, comprising:

receiving a distance between a first sensor and a second sensor;

moving a plurality of tubing segments into or out of the well;

scanning the tubing segments with the first sensor as the tubing segments are being moved into or out of the well;

receiving a first data point from the first sensor;

scanning the tubing segments with the second sensor as the tubing segments are being moved into or out of the well;

receiving a second data point from the second sensor; and determining a depth position for the second data point along the plurality of tubing segments, wherein the depth position comprises the depth of the tubing segments within the well;

calculating a depth position for the first data point based on the distance between the first sensor and the second sensor.

26. The method of claim 25, wherein the first sensor is selected from a wall-thickness sensor, a rod-wear sensor, a crack sensor, an imaging sensor, or a pitting sensor.

27. The method of claim 25, wherein the second sensor is a collar locating sensor.

28. The method of claim 25, wherein the first and second sensors scan the tubing segments at substantially the same time.

29. The method of claim 25, wherein determining the depth position for the second data point comprises receiving a depth position from an encoder.

30. A method for evaluating tubing from a well at a wellsite, comprising:

moving a plurality of tubing segments into or out of the well;

scanning the tubing segments with a sensor as the tubing segments are being moved into or out of the well;

receiving tubing scan data from the sensor;

accepting a first portion of the tubing scan data comprising data representing minimal damage to a portion of one of the tubing segments;

determining a first amplitude for at least a portion of the first portion of the tubing scan data;

receiving a multiplication factor; and adjusting an amplitude of a display of the tubing scan data based on the first amplitude and the multiplication factor.

31. The method of claim 30 further comprising the steps of:

accepting a second portion of the tubing scan data comprising data representing a pipe collar on a portion of one of the tubing segments, the second portion of the tubing scan data comprising a second amplitude; and comparing the second amplitude to the amplitude of the display.

32. The method of claim 31 further comprising the step of decreasing the amplitude of the display based on a determination that the second amplitude is less than the amplitude of the display.

33. The method of claim 31 further comprising the step of generating an alarm that the tubing scan data from the sensor comprises an unacceptable noise level based on a determination that the second amplitude is greater than the amplitude of the display.

34. The method of claim 31 further comprising the step of adjusting a noise level of the tubing scan data from the sensor based on a determination that the second amplitude is greater than the amplitude of the display.

35. A method for evaluating tubing data from at least one of a plurality of tubing segments at a wellsite comprising a well, comprising:

moving the plurality of tubing segments into or out of the well;

analyzing the tubing segments with a tubing scanner, said scanner generating a first signal associated with the condition of said tubing segments;

determining the location of a plurality of pipe collars;

determining the length of each tubing segment;

correlating a relative position of each tubing segment to the first signal; and displaying the correlated tubing scanner data and tubing segment positional data, wherein the scanner data is used to evaluate the tubing segments for defects, integrity, wear, anomalous conditions, or fitness for continued service.

* * * * *